US009050619B2

(12) United States Patent
Ryabova

(10) Patent No.: US 9,050,619 B2
(45) **Date of Patent: *Jun. 9, 2015**

(54) SYSTEM AND PROCESS FOR COATING AN OBJECT

(75) Inventor: Elmira Ryabova, Sunnyvale, CA (US)

(73) Assignee: Advenira Enterprises, Inc., Sunnyvale, CA (US)

( * ) Notice: Subject to any disclaimer, the term of this patent is extended or adjusted under 35 U.S.C. 154(b) by 77 days.

This patent is subject to a terminal disclaimer.

(21) Appl. No.: 13/568,979

(22) Filed: Aug. 7, 2012

(65) Prior Publication Data

US 2012/0301671 A1 Nov. 29, 2012

Related U.S. Application Data

(63) Continuation of application No. 13/481,022, filed on May 25, 2012.

(60) Provisional application No. 61/490,434, filed on May 26, 2011.

(51) Int. Cl.
*B05C 3/00* (2006.01)
*B05C 13/00* (2006.01)
(Continued)

(52) U.S. Cl.
CPC ..... *B05C 13/02* (2013.01); *Y10T 428/24521* (2015.01); *Y10T 428/24364* (2015.01); *Y10T 428/24942* (2015.01); *Y10T 428/24355* (2015.01); *Y10T 428/24322* (2015.01); *Y10T 428/24612* (2015.01); *B05C 15/00* (2013.01); *B05D 1/005* (2013.01); *B05D 1/18* (2013.01); *B05D 3/0263* (2013.01); *B05D 3/065* (2013.01); *B05D 3/142* (2013.01)

(58) Field of Classification Search
None
See application file for complete search history.

(56) References Cited

U.S. PATENT DOCUMENTS 2,558,037 A * 6/1951 Calhoun, Jr. et al. ..... 536/61
3,051,125 A 8/1962 Ahara et al.
(Continued)

FOREIGN PATENT DOCUMENTS

CN 103998360 A 8/2014
EP 2723661 4/2014
(Continued)

OTHER PUBLICATIONS

Holder et al, WO 2008025498, English translation.*
(Continued)

*Primary Examiner* — Charles Capozzi
(74) *Attorney, Agent, or Firm* — Kwan & Olynick LLP

(57) ABSTRACT

Coating systems and processes are disclosed for uniformly coating objects. The system comprises a pre-treatment unit, a first processing unit, a first post-treatment unit and one or more coating apparatus each configured to engage an object and rotate the object around or about two or more axes. The coating apparatus used in the system can comprise a first, second and/or third gimbals connected to rotational mechanisms to allow rotation of the gimbals around or about first, second and/or third axis. An object holder is connected to the third gimbal. When an object is present in the object holder, it can be immersed in a coating solution to form a coated object. The coated object is then rotated around or about two or three axes which produces a multidirectional centrifugal force which causes the coating solution to spread evenly over the surface of the object to produce a uniform thin film.

16 Claims, 16 Drawing Sheets

(51) Int. Cl.

| | |
|---|---|
| ***B05D 3/12*** | (2006.01) |
| ***B05D 1/18*** | (2006.01) |
| ***B05C 13/02*** | (2006.01) |
| ***B05D 1/00*** | (2006.01) |
| *B05C 15/00* | (2006.01) |
| *B05D 3/02* | (2006.01) |
| *B05D 3/06* | (2006.01) |
| *B05D 3/14* | (2006.01) |

(56) References Cited

U.S. PATENT DOCUMENTS

| | | | | |
|---|---|---|---|---|
| 4,196,231 | A | 4/1980 | Hubers | |
| 4,325,995 | A | 4/1982 | Tamura et al. | |
| 4,357,370 | A | 11/1982 | Alheid | |
| 4,440,809 | A | 4/1984 | Vreeland | |
| 4,489,670 | A | 12/1984 | Mosser et al. | |
| 4,533,563 | A | 8/1985 | Dahlgren et al. | |
| 4,643,124 | A | 2/1987 | Switall | |
| 4,670,304 | A | 6/1987 | Miura et al. | |
| 4,737,378 | A | 4/1988 | Narita et al. | |
| 4,808,445 | A | 2/1989 | Fujiwara et al. | |
| 4,871,593 | A | 10/1989 | McIntyre | |
| 4,921,729 | A | 5/1990 | Kaneko et al. | |
| 5,010,840 | A | 4/1991 | Busker et al. | |
| 5,015,500 | A | 5/1991 | Garde | |
| 5,028,457 | A | 7/1991 | Kinose et al. | |
| 5,048,453 | A | 9/1991 | Eriksson | |
| 5,136,682 | A | 8/1992 | Moyer et al. | |
| 5,178,912 | A | 1/1993 | Piacente et al. | |
| 5,262,193 | A | 11/1993 | Louks et al. | |
| 5,310,573 | A | 5/1994 | Tanokuchi et al. | |
| 5,510,141 | A | 4/1996 | Makita et al. | |
| 5,510,147 | A | 4/1996 | Volpe | |
| 5,514,214 | A | 5/1996 | Joel et al. | |
| 5,628,827 | A | 5/1997 | McCollam et al. | |
| 5,631,048 | A | 5/1997 | Kinose et al. | |
| 5,632,815 | A | 5/1997 | Damrau et al. | |
| 5,720,816 | A | 2/1998 | Li et al. | |
| 5,755,883 | A | 5/1998 | Kinose et al. | |
| 5,843,335 | A | 12/1998 | Kurono et al. | |
| 5,912,046 | A | 6/1999 | Eldridge et al. | |
| 5,977,715 | A * | 11/1999 | Li et al. | 315/111.51 |
| 6,037,020 | A | 3/2000 | Garlough et al. | |
| 6,136,374 | A | 10/2000 | Reuscher | |
| 6,143,145 | A * | 11/2000 | Copping et al. | 204/206 |
| 6,145,342 | A | 11/2000 | Bayya et al. | |
| 6,214,272 | B1 * | 4/2001 | Gruenwald et al. | 264/255 |
| 6,343,490 | B1 | 2/2002 | Alonzo et al. | |
| 6,374,158 | B1 * | 4/2002 | Fusaro, Jr. | 700/254 |
| 6,555,157 | B1 | 4/2003 | Hossainy | |
| 6,709,514 | B1 | 3/2004 | Hossainy | |
| 7,790,232 | B2 | 9/2010 | Costa et al. | |
| 8,507,035 | B2 | 8/2013 | Ryabova | |
| 2001/0019004 | A1 * | 9/2001 | Sagane et al. | 198/345.1 |
| 2002/0125141 | A1 * | 9/2002 | Wilson et al. | 205/96 |
| 2003/0113468 | A1 | 6/2003 | Perry et al. | |
| 2003/0114540 | A1 | 6/2003 | Mager | |
| 2003/0122122 | A1 | 7/2003 | Iwata | |
| 2003/0132223 | A1 * | 7/2003 | Ueno | 219/520 |
| 2003/0224122 | A1 | 12/2003 | Lopez | |
| 2003/0225451 | A1 | 12/2003 | Sundar | |
| 2004/0047994 | A1 | 3/2004 | Becker et al. | |
| 2004/0058066 | A1 | 3/2004 | Wei et al. | |
| 2004/0202793 | A1 | 10/2004 | Harper et al. | |
| 2004/0216664 | A1 | 11/2004 | Daggett et al. | |
| 2004/0255848 | A1 | 12/2004 | Yudasaka | |
| 2005/0016201 | A1 * | 1/2005 | Ivanov et al. | 62/434 |
| 2005/0031782 | A1 | 2/2005 | Foster | |
| 2005/0244678 | A1 | 11/2005 | Arfsten et al. | |
| 2005/0277274 | A1 | 12/2005 | Karkkainen | |
| 2005/0279986 | A1 | 12/2005 | Punsalan et al. | |
| 2006/0040109 | A1 | 2/2006 | Mendoza | |
| 2006/0182882 | A1 | 8/2006 | Takahashi et al. | |
| 2006/0213048 | A1 * | 9/2006 | Kalanovic | 29/468 |
| 2007/0027015 | A1 | 2/2007 | Zhou et al. | |
| 2007/0062414 | A1 | 3/2007 | Sato et al. | |
| 2007/0104873 | A1 | 5/2007 | Damrau | |
| 2007/0117365 | A1 * | 5/2007 | Kuriyama et al. | 438/597 |
| 2007/0166872 | A1 | 7/2007 | Prene et al. | |
| 2007/0190361 | A1 | 8/2007 | Amita et al. | |
| 2008/0012074 | A1 | 1/2008 | Braymer et al. | |
| 2008/0029640 | A1 * | 2/2008 | Chiu et al. | 242/615.21 |
| 2008/0029977 | A1 | 2/2008 | Cheng et al. | |
| 2008/0057631 | A1 | 3/2008 | Cheng et al. | |
| 2008/0079075 | A1 | 4/2008 | Seon et al. | |
| 2008/0171140 | A1 | 7/2008 | Hirmer et al. | |
| 2008/0234812 | A1 | 9/2008 | Pacetti | |
| 2009/0101068 | A1 | 4/2009 | Boyd et al. | |
| 2009/0267058 | A1 | 10/2009 | Namdas et al. | |
| 2009/0297923 | A1 | 12/2009 | Backhaus-Ricoult et al. | |
| 2010/0019188 | A1 | 1/2010 | Warren et al. | |
| 2010/0062155 | A1 | 3/2010 | Tajima | |
| 2010/0129646 | A1 | 5/2010 | Fisk et al. | |
| 2010/0170801 | A1 * | 7/2010 | Metzger | 205/101 |
| 2010/0178414 | A1 * | 7/2010 | Judge et al. | 427/2.24 |
| 2010/0229417 | A1 | 9/2010 | Ogawa et al. | |
| 2010/0242800 | A1 | 9/2010 | Chuang | |
| 2012/0301667 | A1 | 11/2012 | Ryabova | |
| 2012/0301670 | A1 | 11/2012 | Ryabova | |
| 2012/0301671 | A1 | 11/2012 | Ryabova | |

FOREIGN PATENT DOCUMENTS

| | | | | |
|---|---|---|---|---|
| HK | 1195542 | A | 11/2014 | |
| JP | 2004071186 | A | 3/2004 | |
| JP | 2011101831 | A | 5/2011 | |
| WO | 02098577 | A1 | 12/2002 | |
| WO | WO 02098577 | | 12/2002 | |
| WO | WO 2008025498 | A1 * | 3/2008 | B05D 1/00 |
| WO | 2009004121 | A1 | 1/2009 | |
| WO | WO 2009004121 | | 1/2009 | |
| WO | 2009059625 | A1 | 5/2009 | |
| WO | WO 2012162643 | | 1/2012 | |
| WO | WO 2012162642 | | 11/2012 | |

OTHER PUBLICATIONS

Holder et al, WO 2008025498, English human translation.*

Jun. 2011 IEEE Presentation.

Sep. 2010 PVSEC Presentation.

Jun. 2010 IEEE Presenatation.

Dec. 2009 Silicon Valley Open Door Presentation.

Nov. 2009 American Vacuum Society Presentation.

Croutxe-Barghorn et al. Photoinitiating Systems for Hybrid Sol-Gel Coatings: Toward Enhanced Materials for UV-Curing Applications, 2005, Rad Tech Europe Conf & Exposition.

Pekcan, O. et al. "In Situ" fluorescence experiments to test the reliability of random bond and site bond percolation models during sol-gel transition in free-radical crosslinking copolymerization, 1996, Polymer. vol. 37, No. 11, pp. 2049-2053.

Sangermano, M. et al. "Developments of Organic-Inorganic Hybrid Free Radical-Cationic Dual Cured Coatings", 2008, Polymer Bull., 59, 865-872.

Efremov, I.F. "The Dilatancy of Colloidal Structures and Polymer Solutions", Russian Chemical Reviews, vol. 51 (2), 285-310 (1982).

Roy, Rustem "Ceramics by the Solution-Sol-Gel Route", Science, vol. 238, pp. 1664-1669, (1987).

Schottner, Gerhard "Hybrid Sol-Gel-Derived Polymers: Applications of Multifunctional Materials", Chem. Mater., vol. 13, 3422-3435 (2001).

"Inverse" Organic-Inorganic Composite Materials 2.1 Free Radical Routes into Nonshrinking Sol-Gel Composition, Macromolecules, vol. 24, 5481-5483, (1981).

Ryabova et al. Novel Back Surface Field (BSF) Structure Formation by Modified Solution Derived Nanocomposite (SDN) Method for Low Cost New Cell Concept Implementation, IEEE, 35th Conf on Photovoltaic, 2010, pp. 2960-2964.

International Application Serial No. PCT/US2012/039652, Invitation to Pay Additional Fees and Partial International Search Report mailed Nov. 27, 2012, 7 pgs.

(56) References Cited

OTHER PUBLICATIONS

International Application Serial No. PCT/US2012/039656, Invitation to Pay Additional Fees and Partial International Search Report mailed Jan. 16, 2013, 8 pgs.
U.S. Appl. No. 13/480,982, Notice of Allowance mailed Jun. 24, 2013, 8 pgs.
U.S. Appl. No. 13/480,982, Non Final Office Action mailed Apr. 12, 2013, 11 pgs.
International Application Serial No. PCT/US2012/039656, International Search Report and Written Opinion mailed Apr. 23, 2013, 17 pgs.
Int'l Application Serial No. PCT/US2012/039652, Preliminary Report on Patentability mailed Feb. 27, 2014, 11 pgs.
Int'l Application Serial No. PCT/US2012/039652, Search Report & Written Opinion mailed Feb. 10, 2014, 17 pgs.
Int'l Application Serial No. PCT/US2012/039656, Preliminary Report on Patentability mailed Dec. 5, 2013, 11 pgs.
U.S. Appl. No. 13/481,02, Notice of Allowance mailed Jan. 15, 2015, 13 pgs.
U.S. Appl. No. 13/481,022, Examiner Interview Summary mailed Oct. 29, 2014, 3 pgs.
U.S. Appl. No. 13/481,022, Non Final Office Action mailed Sep. 3, 2014, 26 pgs.
U.S. Appl. No. 13/481,022, Restriction Requirement mailed Apr. 24, 2014, 11 pgs.

* cited by examiner

SYSTEM AND PROCESS FOR COATING AN OBJECT

This application claims priority to U.S. Provisional Application Ser. No. 61/490,434, filed 26 May 2011, entitled Method and Apparatus for Coating an Object, the disclosure of which is expressly incorporated herein and is a continuation of U.S. patent application Ser. No. 13/481,022 filed May 25, 2012.

TECHNICAL FIELD

Systems and processes are disclosed which enable the uniform coating of an object with a complex surface. Composites are also disclosed comprising an object and a thin film covalently attached to the object.

BACKGROUND OF THE INVENTION

Disk coating is usually carried by methods such as dip coating, spin coating and dip-spin coating. In dip coating the disk is dipped into a coating liquid and then removed to allow excess material to drain from the disk. In spin coating, a disk is placed in a horizontal plane on a rotatable spindle. A coating liquid is applied to the upper surface of the spinning disk which is then spread across the surface of the disk by virtual centrifugal forces. In dip-spin coating an object is dipped in a horizontal plane into a coating liquid and then removed and spun in a horizontal plane to remove excess liquid. A modified dip-spin coater uses a spindle that rotates the disk in a vertical plane. In this approach the edge of the disk is dipped into the coating fluid and rotated to coat the outermost portion of both sides of the disk. The disk is then removed from the coating fluid and spun in a vertical plane to remove excess coating fluid. See US Patent Publication 2004/0202793.

Roll coaters have been used primarily to coat flat surfaces.

In each of the forgoing the thin film has a flat surface which is coplanar with the flat surface of the object.

None of these prior art coaters are designed to uniformly coat the surfaces of objects that are more complex than a typical disk or flat surface. Accordingly, it is an object of the invention to provide coating systems and processes that are capable of coating objects having complex surfaces.

SUMMARY OF THE INVENTION

In a preferred embodiment, the system for coating an object comprises four components: (1) a pre-treatment unit; (2) a first processing unit; (3) a first post-treatment unit and (4) one or more coating apparatus each configured to engage an object and rotate it around or about two or more axes. The system is configured so that coating apparatus can be transported between the pre-treatment unit and the first processing unit and between the first processing unit and the first post-treatment unit. The system and or units are preferably enclosed so that the temperature and atmosphere within the system or units can be controlled.

A track structure can be incorporated into the system above the various units. The track system includes a track and appropriate drive and control mechanisms to transport the coating apparatus as it traverses the track and to stop the coating apparatus at appropriate positions in the treatment and processing units.

The system preferably has an entry port which is before or upstream from the pre-treatment unit so that an object to be coated can be attached to the coating apparatus. More preferable the object is attached to a coating apparatus which is external to the enclosed portion of the system. In the latter situation, the track system preferably extends outward from the enclosed system and supports the coating apparatus. Thereafter, the coating apparatus can be transported via the track system through the entry port and into the pre-treatment and other units as necessary. After the object is coated and treated, the system reverses the movement of the coating apparatus so that the object can be removed at the entry port.

In a preferred embodiment, the system includes an exit port after the post-treatment unit. Such a configuration allows for continuous operation of the system in which a first coating apparatus can enter the system at the pre-treatment unit, move to the processing unit to be coated, move to the post-treatment unit for irradiation and exit via the exit port. A second coating apparatus can enter the system at the pretreatment unit as the first coating apparatus exits it. This allows for multiple coating apparatus to be present in the system thereby increasing the operational efficiency of the system.

The coating apparatus comprises a first gimbal connected to a first mechanism to rotate the first gimbal around or about a first axis; a second gimbal connected to the first gimbal to allow rotation around or about a second axis; a second mechanism connected to the second gimbal to rotate the second gimbal around or about the second axis; and an object holder connected to the second gimbal. When so configured the object holder and the object in the object holder is rotatable around or about the first and second axes.

In another embodiment, the coating apparatus comprises a first gimbal connected to a first mechanism to rotate the first gimbal around or about a first axis; a second gimbal connected to the first gimbal to allow rotation around or about a second axis; a third gimbal connected to the second gimbal to allow rotation around or about a third axis; a second mechanism connected to the second gimbal to rotate the second gimbal around or about the second axis; a third mechanism connected to the third gimbal to rotate the third gimbal around or about the third axis; and an object holder connected to the third gimbal. This configuration provides for rotation of the holder and the object around or about the first, second and third axes The system can also include a second processing unit and a second post-treatment unit. The second processing unit is configured to receive the coating apparatus from the first post-treatment unit and the second post-treatment unit is configured to receive the coating apparatus from the second processing unit.

In some embodiments, the first processing unit is configured to receive the coating apparatus from the second post-treatment unit to form a transit circuit for the coating apparatus.

In a preferred embodiment, the pretreatment unit contains a plasma head. The plasma head can produce, for example, an atmospheric plasma or oxygen plasma which contacts the surface of the object to be coated. A preferred plasma head is a six axis plasma head which is capable of exposing all or part of the surface of the object.

The pre-treatment of the object's surface activates the surface which in turn increases the number of covalent bonds formed between the object's surface and the thin film. This pre-treatment results in a thin film that adheres more strongly to the surface than if plasma pre-treatment is not performed. Plasma treatment of the thin film surface can also be used to increase the adherence of a second thin film to the first thin film. In this embodiment, the coating apparatus is transported to a pre-treatment unit for plasma treatment and then coated with the same or different coating fluid. This approach using plasma pre-treatment of thin film surfaces can be repeated for subsequent thin films.

The process for coating an object comprises pre-treating one or more surfaces of an object, immersing all or part of the object into a coating fluid along a first vertical axis, optionally rotating the object around or about the first vertical axis while immersed in the coating fluid, optionally rotating the object around a second axis while immersed in the coating fluid, withdrawing the object from coating fluid to form a coated object, rotating the coated object around or about the vertical axis after the withdrawing, rotating the coated object around or about said second axis after said withdrawing, and post-treating the coated object.

The process can also include rotating the object around or about a third axis.

The pre-treatment can comprise exposing all or part of the surface of the object to plasma.

The post-treatment can include exposing all or part of the surface of the coated object to at least one of UV, visible and IR radiation. The wavelength, intensity and duration of the exposure can be varied. The post-treatment can also be achieved with utilization of two or more of UV, visible and IR radiation and in some cases by use of the full electro-magnetic spectrum including micro-waves, as well as high-energy radiation. This post treatment can also include mono-chromatic laser light of a single frequency.

A composite comprises an object and a thin layer covalently attached to all or part of one or more surfaces of the object. The thin film has an adhesion value greater than 3B as measured by the ASTM D3359 cross-hatch adhesion test. The thin film can be an extended thin film that has a uniform thickness which in some embodiments varies by no more than 10% of the overall thickness dimension of the thin film. In some embodiments, the surface of the thin film is smoother than the coated surface of the object.

In some cases the object has a complex surface where the thin film covers all or part of the complex surface. A complex surface comprises (a) a non-planar surface, (b) two or more planar surfaces meeting at an angle other than 90 degrees; (c) at least one three dimensional internal or external feature associated with a surface of the object or (d) combinations thereof.

In some cases the three dimensional feature is microscopic. In some embodiments, all or part of the three dimensional microscopic feature is coated with a conformal thin film.

The composite can also comprise three dimensional nanoscopic features. In some embodiments, all or part of the three dimensional nanoscopic feature is coated with a conformal thin film.

The composite can also comprise a multilayer thin film where a second thin film covers all or part of the thin film attached to the surface of the object. In some embodiments, this second thin film has an adhesion value to the first thin film which is greater than 3B as measured by the ASTM D3359 cross-hatch adhesion test.

BRIEF DESCRIPTION OF THE DRAWINGS

FIG. 14 B is a perspective view of apparatus 26 and object 28.

DETAILED DESCRIPTION OF PREFERRED EMBODIMENTS

Figure 1:
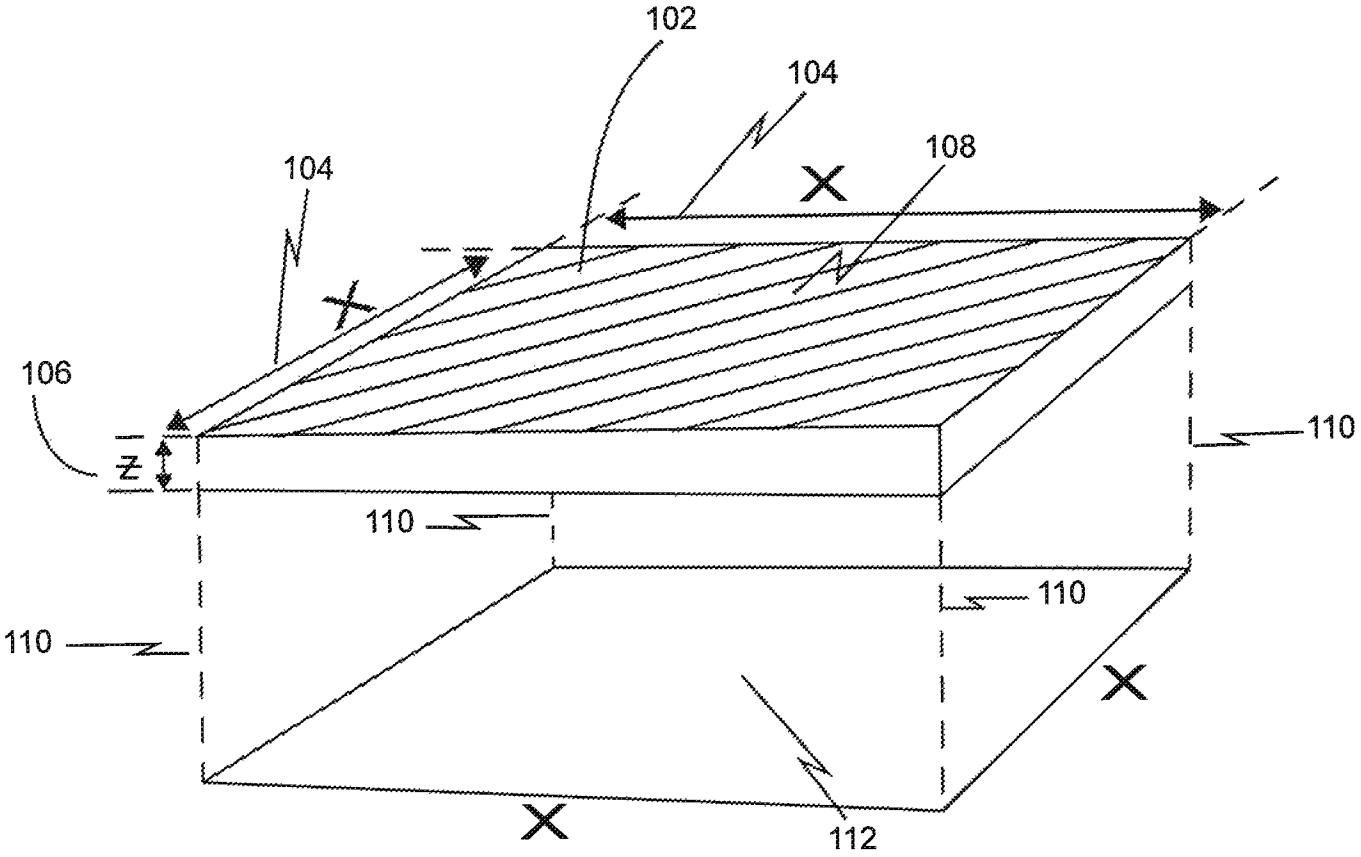
FIG. 1 depicts a square flat object with a coating on a flat surface and the largest two dimensional area of the object.

Uniform coating is problematical when the surface of an object is complex such as when the object has a non-planar surface or a three dimensional feature is associated with a planar or non-planar surface. For example, if the three dimensional feature extends externally from the surface, coating fluid can pool around it. If it extends internally, coating fluid can either pool in the feature or not enter it, to coat its surface, depending on viscosity of the coating fluid, the dimensions of the feature and the orientation of the feature when immersed in the coating fluid.

Overlying Principal

These problems are overcome by applying a coating solution to one or more complex surfaces of an object and subjecting the object to a multidirectional centrifugal force. This is multidirectional centrifugal force together with the force of gravity creates a three dimensional tensor force applied over one or more complex surfaces of the object. This causes the coating solution to spread evenly over all or part of the complex surface to produce a uniform thin film.

The centrifugal force, which is a virtual or fictitious force, is actually the absence of centripetal forces, and is used in this context for heuristic purposes to describe the apparent acting forces on the liquids during rotation. This heuristic centrifugal force is controlled by:

(1) the rate of rotation of the object around first and second axes;

(2) the rate of rotation of the object around the first axis and the angle of the object about the second axis;
(3) the rate of rotation of the object around first, second and third axes;
(4) the rate of rotation of the object around the first and second axes and the angle of the object about the third axis;
(5) the rate of rotation of the object around the first axis and the angle of the object about the second and/or third axes;
(6) the direction of rotation on the object around one or more axes; and
(7) the direction of rotation about one or more axes to change the angle of the object about the one or more axes.

The rate of rotation and/or the angle of an object around or about two or more axes is chosen to apply a specific centrifugal force at a particular point on a surface of the object.

When the appropriate centrifugal forces are applied, the coating solution becomes uniformly distributed across the portion of the object being coated. In some embodiments, the coated portion includes one or more complex surfaces of the object. The uniform solution forms a uniform thin film on the object to produce the disclosed composite.

In a preferred embodiment, the composite comprises: an object, wherein at least all or part of one or more of the surfaces of said object comprises a complex surface; and a thin film covering all or part of one or more complex surfaces of said object; wherein the thin film has a uniform thickness over all or part of the complex surface.

Complex Objects

As used herein, a "complex object" or "object with a complex surface" or grammatical equivalents refers to any object with at least one complex surface. As used herein, a macroscopic "complex surface" is (a) a non-planar surface, (b) two or more planar surfaces meeting at an angle other than 90 degrees; (c) at least one three dimensional internal or external feature associated with an otherwise planar surface of the object or (d) combinations thereof. Macroscopic complex objects do not include objects that have six orthogonal surfaces, such as cubes etc.

An example of a macroscopic non-planar surface is the surface of a sphere or a half sphere forming the end surface of a cylindrical object. The surface of the cylinder is also a non-planar surface.

A pyramid is an example of a complex object where macroscopic planar surfaces meet at an angle other than 90 degrees. A rhombohedral structure is another example of an object having macroscopic surfaces that meet at other than 90 degrees.

Examples of three dimensional features include one or more of projections, depressions, holes, orifices, surface channels, internal channels, plateaus, undulations, curvatures, embossments, tranches, mesa patterns and plenums and combinations thereof that are associated with a macroscopic surface. In many instances, the features have a high aspect ratio (HAR). HAR's typically range from 2-1, 5-1, 10-1, 100-1 and >100-1.

A parameter that is sometimes useful to determine if a complex surface is present on an object is the coefficient of complexity. As used herein, the "coefficient of complexity", "complexity coefficient" or grammatical equivalents is the ratio of (a) the total surface area covered by the thin film to (b) the largest 2 dimensional projected area of the object or the largest 2 dimensional projected area of the portion of the object which is coated. The largest projected area of the object is the actual or mathematical project of the coated object on a planar surface. If there is a complex surface, the coefficient of complexity will be greater than 1. Computer Assisted Drawing (CAD) software programs can be used to project 3D objects onto a 2D view. One source is Adobe Systems, Inc., San Jose Calif.

FIG. 1 shows a thin square object 102 (not to scale) having a side length 104 of length x and a thickness 106 of length z, where z=0.2x. Assume one surface of the square is coated with a thin film 108. See cross hatch on surface of object 102. The surface being coated is $x^2$. Lines 110 project on a planar surface to produce the largest two dimensional area (112) of the object. The largest projected area of the object is also $x^2$. The complexity coefficient for a flat surface on a flat square substrate is therefore 1. A flat surface is therefore not a complex surface. This object is also not a macroscopic complex object because it has six orthogonal surfaces.

Figure 2:
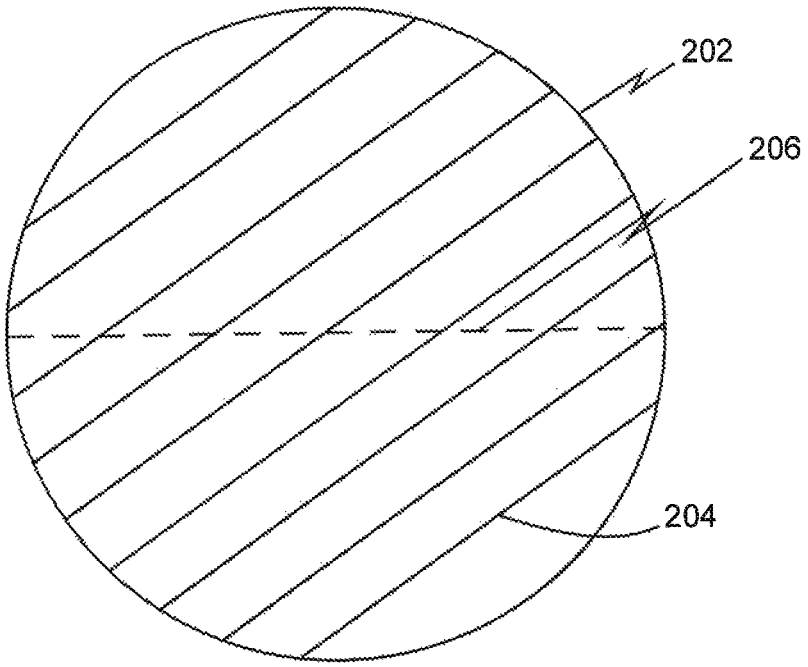
FIG. 2 is a cross section of sphere with a thin film coating covering the entire surface.

However, if the entire surface area of a sphere is covered by a thin film, the area covered is $4\pi r^2$. See FIG. 2 which is a cross section of sphere with a thin film coating depicted as 204. The largest 2 dimensional projected area of the coated object is the area of circle 206 bisecting the sphere, i.e. $\pi r^2$. The complexity coefficient is therefore 4.

Figure 3:
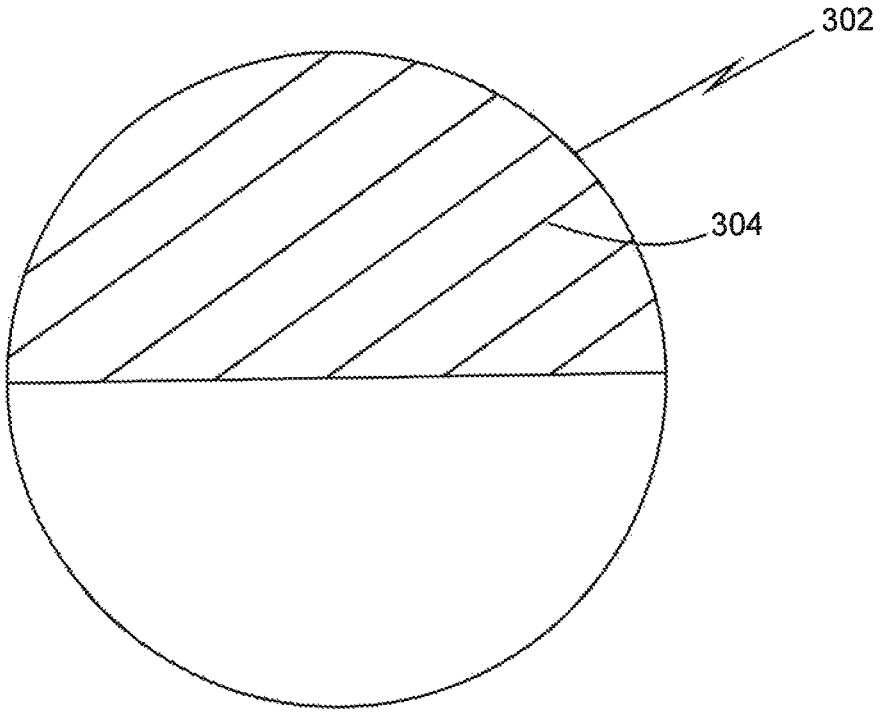
FIG. 3 is a cross section of sphere with a thin film coating covering half of the sphere.

FIG. 3 is a cross section of sphere 302 where only half of the sphere is covered with a thin film 304. The largest 2 dimensional projected area of the coated object is again the area of the circle bisecting the sphere. The complexity coefficient is therefore $4\pi r^2/2$ divided by $\pi r^2$ or 2.

Figure 4:
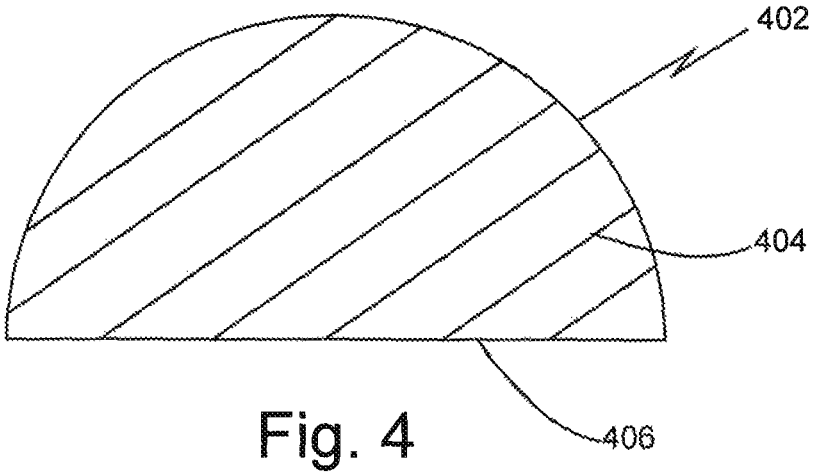
FIG. 4 is a cross section of a half sphere in which the semi-spherical surface 404 and flat circular surface is totally covered with a thin film.

FIG. 4 is a cross section of a half sphere 402 in which the semi-spherical surface 404 and flat circular surface 406 is totally covered with a thin film. The total area covered is $4\pi r^2/2+\pi r^2$. The largest 2 dimensional projected area of the coated object is the area of the circle at the base of the object. The complexity coefficient is therefore $4\pi r^2/2+\pi r^2$ divided by $\pi r^2$ or 3.

Figure 5:
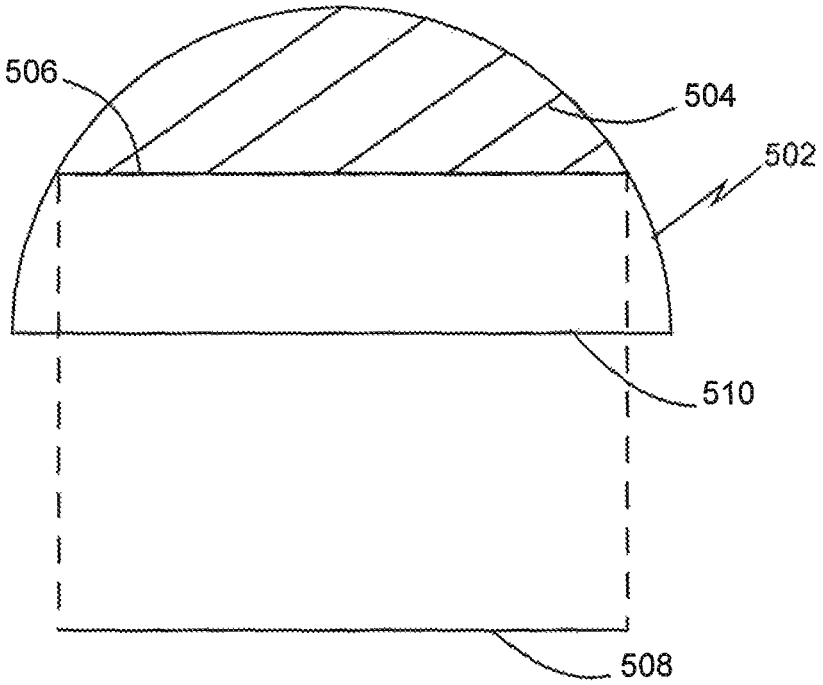
FIG. 5 is a cross section of a half sphere in which only a part of the half sphere is covered with a thin film.

FIG. 5 is a cross section of half sphere 502 in which only a part of half sphere 502 is covered with a thin film 504. In this case the coated object is sometimes referred to as a "coated pseudo object" or "pseudo object" defined by the portion of the object being coated. As used herein, the term "coated pseudo object" refers to that portion of an object defined by the coated surface and the smallest imaginary surface inside the object that connects the edges of the coating surface. In this case, the imaginary surface is circle 506 which has an area which is less than the area of the circle 510 forming the base of the half sphere. That imaginary circle also is the largest 2 dimensional projected area 508 of the coated pseudo object. The complexity coefficient of this pseudo object is greater than 1

In some cases the complexity coefficient is determined for all or part of one or more three dimensional features on a surface of an object. For example, if a number of high aspect ratio features such as cylinders project from surface 108 of object 102 in FIG. 1 but only half of each cylinder is coated each of the half coated cylinders defines a pseudo object. The complexity coefficient is the ration of the coated area of the cylinder ($\pi r^2+(2\pi)(\frac{1}{2}h)$) divided by the largest projected area of the pseudo object ($2r\times\frac{1}{2}h=rh$). If h equals r, the complexity coefficient is $2\pi$.

In some cases, the complexity coefficient is greater than 2, 3, 4, 5, 6 or higher. In some cases the complexity coefficient is $\pi$ or multiples of $\pi$.

The foregoing describes complex surfaces on the macroscopic scale. However, complex surfaces can also be viewed from the microscopic (micron) and nanoscopic (nanometer) scale.

Most surfaces, including complex macroscopic surfaces, have some degree of surface roughness (R), typically measured on the microscopic or nanoscopic scale. This roughness can be random because of the composition used to make the object and how it was manufactured. Roughness may also be the result of intentionally forming microscopic or nanoscopic features on a surface. For example, a Fresnel lens can have groves that can be 100μ in height and width. In this situation the groves contribute to the roughness of the surface. In each case, the surface roughness is caused by surface features which when viewed in isolation are themselves microscopic or nanoscopic complex objects with complex surfaces. They also contribute to the complexity coefficient of the surface since they increase the effective surface area under consideration.

Thin Films

On a microscopic scale, thin films can have a thickness between 1μ and 1000μ but are usually in the range of 1μ to about 500, 1μ to 250μ, 1μ to 100μ or 1μ to 10μ. The minimal thickness in these ranges can be 2μ, 5μ, 10μ or 100μ.

On a nanoscopic scale thin films can have a thickness between 1 nm and 1000 nm, 1 nm to about 500, 1 nm to about 250 nm, 1 nm to 100 nm or 1 nm to 10 nm. The minimal thickness in these ranges can be 2 nm, 5 nm, 10 nm or 100 nm.

Figure 6:
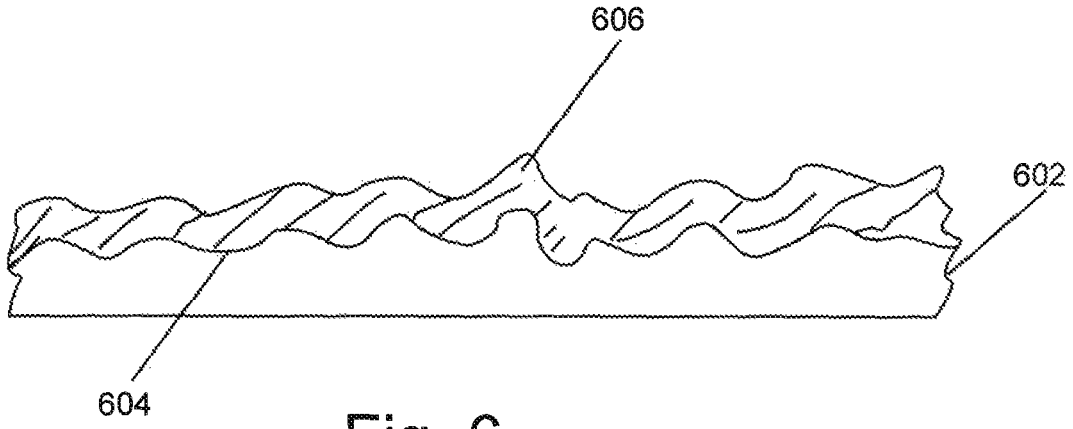
FIG. 6 is a cross section of an object which has a rough surface and a thin film which conforms to the rough surface on the object.

Thin films can be flat or conformal. Flat thin films are thin films with at least one flat surface. Flat thin films are usually associated with thin film coatings on macroscopic surfaces Conformal thin films are thin films that conform to the features associated with a surface. FIG. 6 is a cross section of an object 602 which has a rough surface 604. Thin film 606 conforms to the rough surface 604 on object 602.

Figure 7:
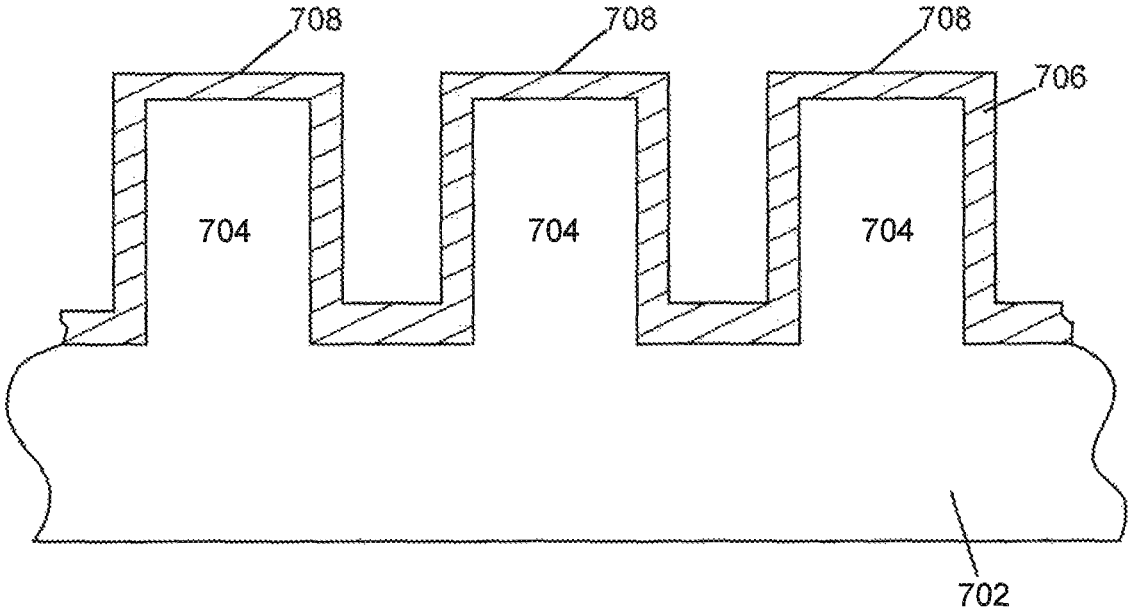
FIG. 7 is a cross section of a Fresnel lens which has periodic projections on the order of 100 to 500μ in height and separation. a thin film conforms to the complex surface of the lens.

FIG. 7 is a cross section of Fresnel lens 702. Lens 702 has periodic projections 704 which are on the order of 100 to 500μ in height and separation. Thin film 706 conforms to the surface of these projections and the remainder of the lens surface.

In one aspect, a conformal coating is defined by its thickness as compared to the roughness of the surface. There are many ways to measure roughness as is known to those skilled in the art. In general a thin film is conforming if the thickness T is less than R/2. If T is greater than 2R the thin film is flat or level and is said to "level out the surface roughness".

Figure 16:
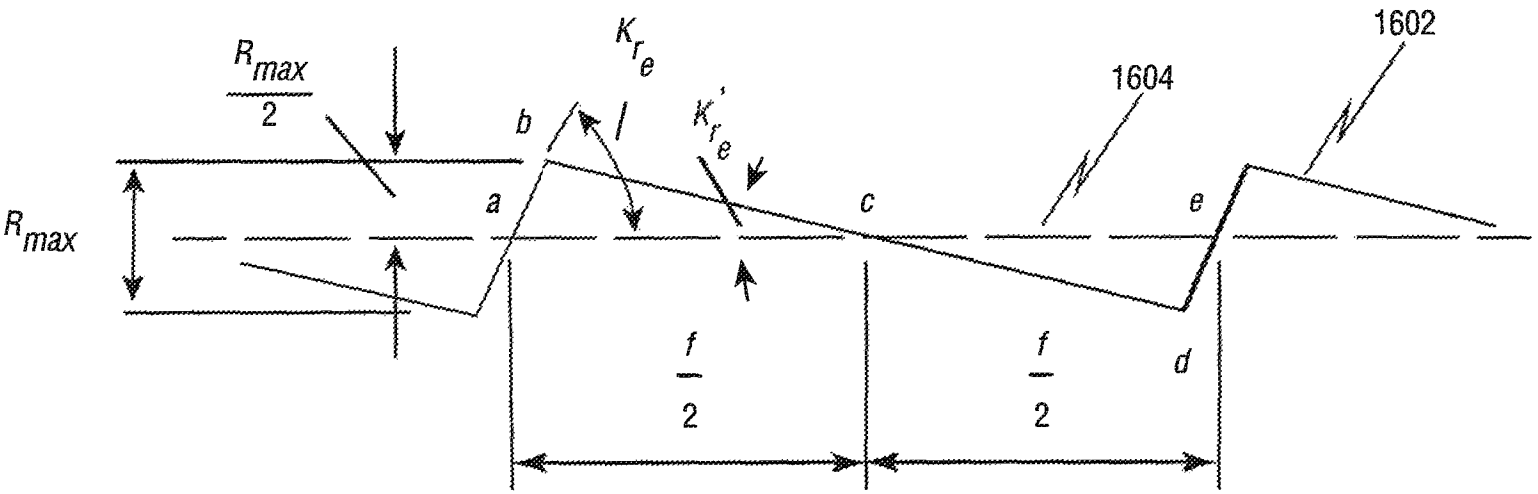
FIG. 16 is a cross section of a complex surface which identifies some of the parameters that can be used to determine roughness of the surface.

Among these descriptors, the Ra measure is one of the most effective surface roughness measures commonly adopted in general engineering practice. It gives a good general description of the height variations in the surface. FIG. 16 is a cross section of a complex surface 1602 which identifies some of the parameters that can be used to determine roughness of the surface. It depicts mean line 1604 which is parallel to the general surface direction and divides the surface in such a way that the sum of the areas formed above the line is equal to the sum of the areas formed below the line. The surface roughness Ra is now given by the sum of the absolute values of all the areas above and below the mean line divided by the sampling length. Therefore, the surface roughness value is given by:

$$Ra=(|\text{area } abc|+|\text{area } cde|)/f.$$

where f is the feed.

The standard definition of the surface roughness can be given as:

$$R_n = \frac{1}{n}\sum_{i=1}^{n}|y_i|$$

where Ra is the arithmetic average of the absolute values of the collected roughness data points $y_i$ is for each point is (|area abc|+|area cde|)/f. The average roughness, Ra, is expressed in units of height.

However, the roughness of a surface can be measured in different ways which are classified into three basic categories:

(1) Statistical descriptors that give average behavior of the surface height. For example, average roughness Ra; the root mean square roughness Rq; the skewness Sk and the kurtosis K;

(2) Extreme value descriptors that depend on isolated events. Examples are the maximum peak height Rp, the maximum valley height Rv, and the maximum peak to valley height Rmax; and (3) Texture descriptors that describe variations of the surface based on multiple events. An example for this descriptor is the correlation length.

Note that a dimensionless surface roughness, Coefficient of Surface Roughness (Csr), can also be defined which would be: the ratio of the measured surface roughness to the maximum height of a surface feature describing the surface. In this regard, the closer the value of Csr to one, the greater the surface variation. In the cases where Ra may be smaller and also substantially smaller than the maximum surface element, the surface is relatively smooth and Csr<1. For topologically smooth surfaces Csr approaches zero, and also the maximum element size approaches zero, and the rate of approach will determine the ratio that Csr will approach.

Thin films in many cases will coat the entire surface of an object even one containing one or more complex surfaces. However, in some cases only a portion of the surface is coated. This can be facilitated by masking that part of the object which is not to be coated as is well known to those skilled in the art. In some cases, at least 10%, 20%, 30%, 40%, 50% 60% 70%, 80%, or 90% or more of the object is coated. When the object contains a complex surface, at least 10%, 20%, 30%, 40%, 50% 60% 70%, 80%, or 90% or more of the complex surface is coated.

Additional thin films can be added to a coated object in which case the thin film layers taken together are sometimes referred to as a multilayer thin film. In some embodiments, the thin films in the multilayer thin film are uniform thin films and/or covalently attached thin films as discussed below Uniform Thin Films As used herein, the term "uniform thin film" or grammatical equivalents refers to the thin film having uniform thickness. A thin film has a uniform thickness if the thickness varies by no more than 10 percent, more preferably, no more than 5 percent and, most preferably, no more than 1 percent. The thickness can be measured as the difference between the average height of the object's surface and the average height of the thin-film surface.

The height of the object's surface relative to the height of the thin-film surface can be measured by (1) direct mechanical measurement, (2) optical interferometry, (3) cross sectional analysis or (4) eddy current analysis.

The height of the object's surface relative to the height of the thin-film surface can be measured from a cross-section of the coated object, using transmission electron microscopy or scanning electron microscopy. The measurement is preferably made over a cross-section that is at least three times as long as the thin film is wide, five times as long as the thin film is wide, ten times as long as the thin film is wide, preferably, 100 times the length of the thin-film width and, most preferably, 1000 times the length of the thin-film width. In some cases the thickness is measured over all or part or multiple parts of the features present on a complex surface such as the thickness of the thin film portions 708 on Fresnel lens 702 in FIG. 7 or over all or part or multiple parts of the complex surface.

The smoothness of the surface of the thin film can be measured using scanning electron microscopy or atomic force microscopy, as well as by simpler approach such as embodied by a Surfscan type system. A smooth thin-film surface is substantially free from irregularities, roughness, or projections. Smoothness can be defined as a surface having a Csr<½ as defined above.

Covalently Attached Thin Films

In some embodiments, the thin film is covalently attached to the surface of an object. Some prior objects had thin films that were covalently attached to the surface of the object. However, the thin films disclosed herein have a greater adhesion to the surface of the object as compared to prior art thin films.

A convenient test for measuring covalent adhesion to a surface is the ASTM D3359 cross-hatch adhesion test which is well known to the skilled artisan. Prior art thin layer coatings can be categorized as having an adhesion value of 3B or less. The thin layers disclosed herein, have an adhesion value which is greater than 3B, 3.5B, 4.0B, 4.5B or 5.0B. Further, in some embodiments a second thin film is covalently attached to a first thin film, as when a multilayer thin film is attached to the surface of an object. When this is the case, the second thin film can have an adhesion value which is greater than 3B, 3.5B, 4.0B, 4.5B or 5.0B and so on for additional thin film layers.

Increased adhesion of a thin film to a surface can be produced by treating the surface (object surface of thin film layer) to increase the number of chemically reactive groups or atoms on the surface. These chemically reactive groups or atoms react with one or more components in the coating fluid so that the resulting thin film is attached to the surface by more covalent bonds than would be the case without surface pre-treatment.

A preferred surface treatment involves treating the surface with plasma, such as the plasma produced by an atmospheric plasma or oxygen plasma generator.

When a multilayer this film is produced, each of the layers can be treated with plasma prior to adding the coating solution which forms the next layer. In this way increased adhesion between layers and between the multilayer thin film and the surface of the object can be achieved. In essence this treatment enhances the performance of the coating by increasing the strength of the links between layers and between the layers and the surface of the object.

The disclosed covalently attached thin films can coat any surface of an object including planar surfaces. However, in preferred embodiments, the thin films are covalently attached to all or part of a complex surface on an object as defined above. The covalently attached thin films can also be uniform thin films as described above.

Objects

Macroscopic objects include solar cells, fuel cells, engine parts, turbine blades, propellars, valves, flanges, automotive parts, such as mufflers and wheel rims, components of semiconductor processing equipment, pipes and tubing, pre-cut semiconductor wafers, flexible electronics and standard electronic boards. A pre-cut semiconductor wafer typically has a diameter of eight to twelve inches and contains a multiplicity of chips or processors.

Macroscopic objects typically have at least one dimension that is greater than 1 cm, 2 cm, 3 cm, 4 cm, 5 cm, 6 cm, 7 cm, 8 cm, 9 cm or 10 cm or more and can be as high as 1-5, 1-4, 1-3 or 1-2 meters or greater.

Apparatus with Two Axes of Rotation

As used herein, the term "gimbal" refers any pivoted support that allows for the rotation of an object around or about a single axis. In some embodiments using two gimbals, it is preferred that the axes of rotation for the two gimbals intersect at the same point. When three gimbals are used it is preferred that at least two and preferably three of the axes intersect at the same point.

As used herein, the term "rotation around an axis" or grammatical equivalents refers to rotation of at least 360 degrees around the axis.

As used herein, the term "rotation about an axis" or grammatical equivalents refers to rotation of less 360 degrees around the axis. In the disclosed embodiments, an object is rotated about an axis to change the angle of the object relative to a second axis.

Figure 8:
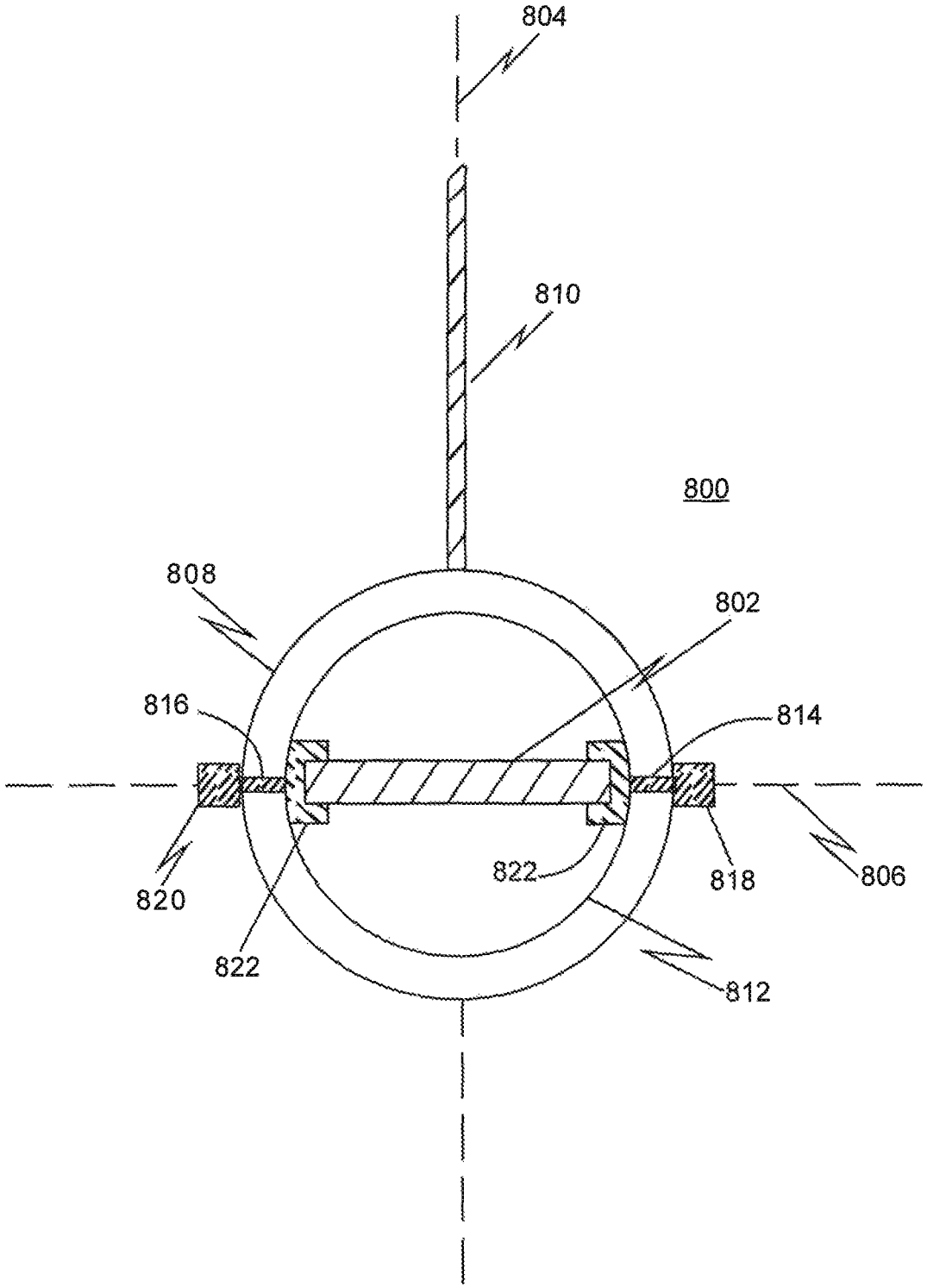
FIG. 8 depicts an apparatus which can rotate an object around two axes.

FIG. 8 depicts an apparatus 800 for rotating an object 802 around vertical axis 204 and horizontal axis 806. First gimbal 808 is attached to drive shaft 810, which, in turn, is rotatably attached to a motor (not shown). A second gimbal 812 is rotatably attached to the first gimbal 808 via rotatable shafts 814 and 816. These shafts, in turn, are connected to motors 818 and 820. Two opposing object holders 822 are attached to gimbal 812 and are designed to engage and hold object 802 when the first gimbal is rotated around axis 804. Object 802 rotates in a horizontal plane. When motors 818 and 820 are activated, object 802 rotates around horizontal axis 806.

Apparatus 800 can be immersed into a coating fluid to coat object 802. The apparatus can then be withdrawn and rotated around axis 804 and/or 806 to uniformly distribute the coating fluid on the surfaces of object 802. After further treatment, a uniform thin film is formed on object 802 to form a composite.

Coating Apparatus with Three Axes of Rotation

Figure 9:
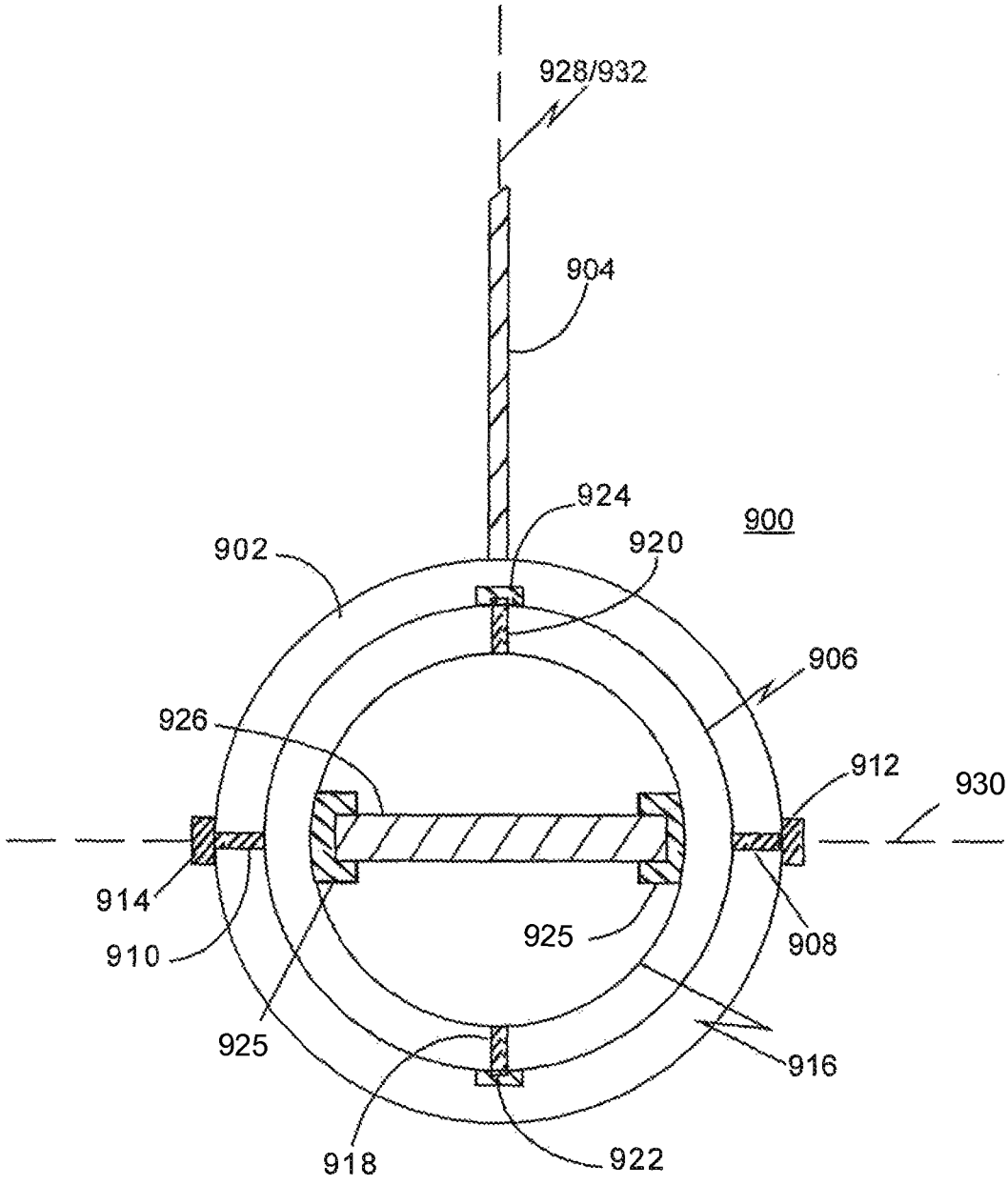
FIG. 9 depicts an apparatus which can rotate an object around three axes.

FIG. 9 depicts a first gimbal 902, which is connected to drive shaft 904, which, in turn, is connected to an electric motor (not shown). A second gimbal 906 is rotatably attached to the first gimbal 902 via shafts 908 and 910. Shafts 908 and 910 are attached, respectively, to motors 912 and 914. A third gimbal 916 is rotatably attached to second gimbal 906 via shafts 918 and 920. Shaft 918 is attached to motor 922, while shaft 920 is connected to motor 924. Two opposed object holders 925 are attached to third gimbal 916. Object 926 is engaged and held by object holders 925.

Gimbals 906 and 916 are depicted in a locked position. When drive shaft 904 is rotated around vertical axis 928, object 926 rotates in a horizontal plane around axis 928. When motors 912 and 914 are activated, object 926 rotates around axis 930. In addition, gimbal 906 rotates out of the plane of FIG. 5. As it rotates out of the plane, rotational axis 932 (which is shown to be coextensive with rotational axis 928) also rotates out of the plane to provide a third axis of rotation for object 926.

As with the coating apparatus having two axes of rotation, coating apparatus 900 can be immersed in a coating fluid, withdrawn and rotated about one or more of axes 930, 928, and 932 to produce a uniform thin film on object 926. The gimbals in FIGS. 8 and 9 are circular. However, the gimbals can be square, rectangular, octagonal, curved or any other configuration that permits rotation around or about two or three axes. Gimbals may also be open structures and have only one rotational point od attachment to each other.

Figure 10:
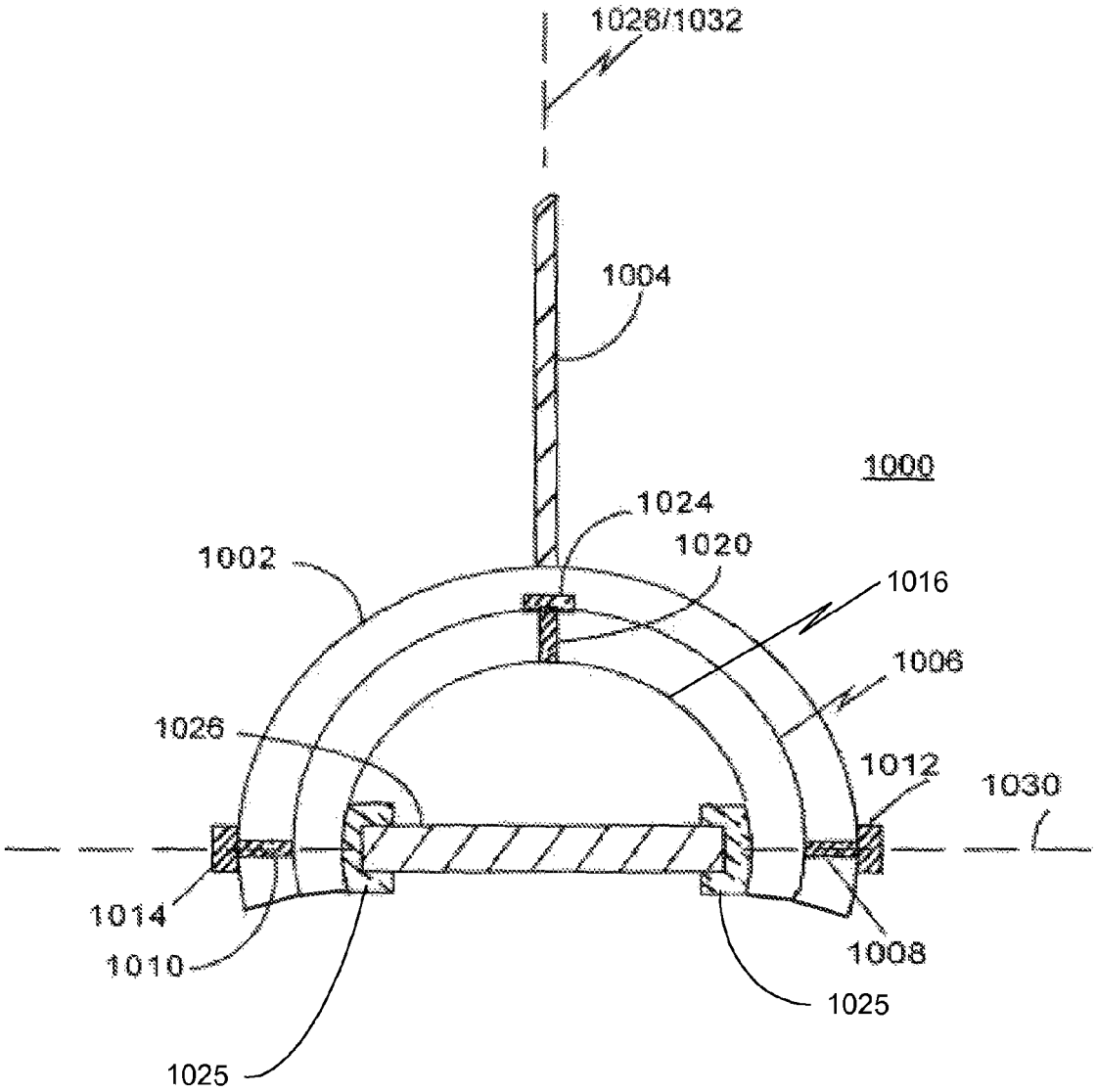
FIG. 10 depicts another embodiment of an apparatus which can rotate an object around three axes.

FIG. 10 depicts a first semi-circular gimbal 1002, which is connected to drive shaft 1004, which, in turn, is connected to an electric motor (not shown). A second semicircular gimbal 1006 is rotatably attached to the first semi-circular gimbal 1002 via shafts 1008 and 1010. Shafts 1008 and 1010 are attached, respectively, to motors 1012 and 1014. A third semi-circular gimbal 1016 is rotatably attached to second semi-circular gimbal 1006 via shaft 1020. Shaft 1020 is connected to motor 1024. Two opposed object holders 1025 are attached to third semi-circular gimbal 1016. Object 1026 is engaged and held by object holders 1025.

Semi-circular gimbals 1006 and 1016 are depicted in a locked position. When drive shaft 1004 is rotated around vertical axis 1028, object 1026 rotates in a horizontal plane around axis 1028. When motors 1012 and 1014 are activated, object 1026 rotates around axis 1030. In addition, semi-circular gimbal 1006 rotates out of the plane of FIG. 10. As it rotates out of the plane, rotational axis 1032 (which is shown to be coextensive with rotational axis 1028) also rotates out of the plane to provide a third axis of rotation for object 1026.

As with the coating apparatus having two axes of rotation, coating apparatus 1000 can be immersed in a coating fluid, withdrawn and rotated about one or more of axes 1030, 1028, and 1032 to produce a uniform thin film on object 1026.

Figure 11:
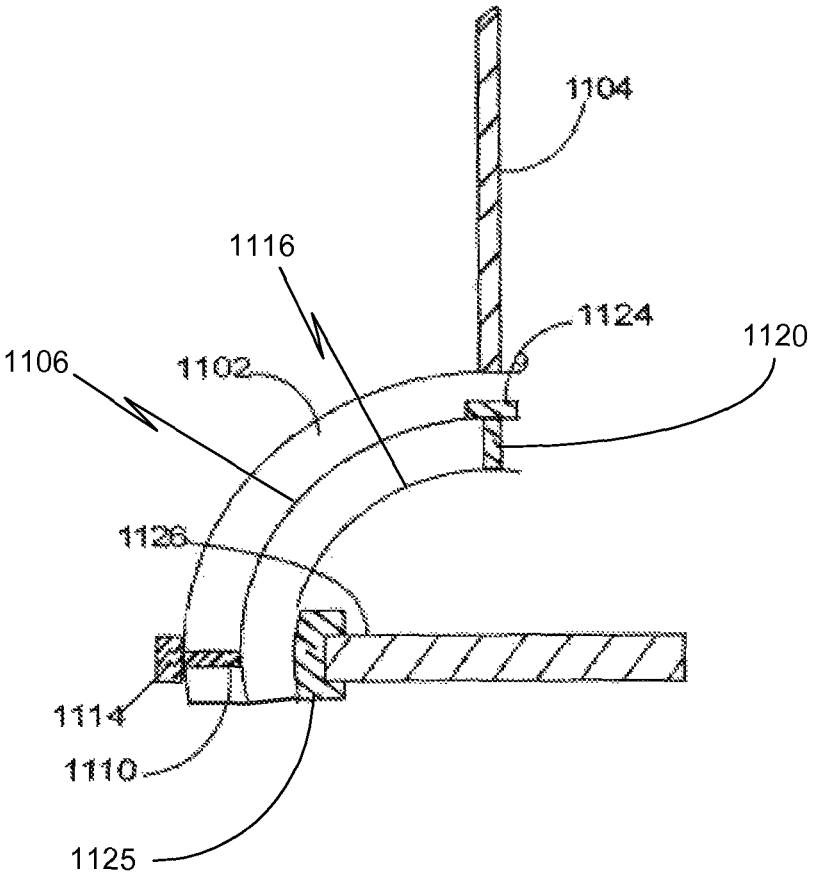
FIG. 11 depicts still another embodiment of an apparatus which can rotate an object around three axes.

FIG. 11 depicts a quarter-circular first gimbal 1102, which is connected to drive shaft 1104, which, in turn, is connected to an electric motor (not shown). A quarter-circular second gimbal 1106 is rotatably attached to the first quarter-circular gimbal 1102 via shaft 1110. Shaft 1110 is attached to motor 1114. A third quarter-circular gimbal 1116 is rotatably attached to second quarter-circular gimbal 1106 via shaft 1120. Shaft 1120 is connected to motor 1125. Object holder 1125 is attached to quarter-circular gimbal 1116. Object 1126 is engaged and held by object holder 1125.

This apparatus can be operated in the same manner as described for the apparatus in FIGS. 9 and 10.

The rotational speed around any or all of the three axes or the two axes in the previous embodiment can be in the range of 1-5000 rpm. The lower rotational limit can be 2, 3, 4, 5, 6, 7, 8, 9, 10, 25, 50, 75, 100, 125, 150, 200, 250, 500, 750, 1,000, 1500 or 2,000 rpm. The upper rotational limit can be 4500, 4000, 3500, 3000, 2500, 2000, 1500, 1000, 500, 250 or 100 rpm. The rpm range can be any combination of these upper and lower limits. Preferred ranges are 3-1000 rpm, 3-500 rpm, 4-1000 rpm, 4-500 rpm, 5-1000 rpm, 5-500 rpm, 10-1000 rpm, 10-500, rpm, 25-1000 rpm, 25-500, rpm 50-1000 rpm, 50-500 rpm, 100-1000 rpm, 100-500 rpm, 150-1000 rpm and 150-500 rpm.

The number of revolutions for a typical object coating operation can range from range of 1-5000 revolutions or higher depending on the application. The lower revolution limit can be 2, 3, 4, 5, 6, 7, 8, 9, 10, 25, 50, 75, 100, 125, 150, 200, 250, 500, 750, 1,000, 1500 or 2,000 revolutions. The upper revolution limit can be 4500, 4000, 3500, 3000, 2500, 2000, 1500, 1000, 500, 250 or 100 revolutions. The revolution range can be any combination of these upper and lower limits. Preferred ranges are 3-1000 revolutions, 3-500 revolutions, 4-1000 revolutions, 4-500 revolutions, 5-1000 revolutions, 5-500 revolutions, 10-1000 revolutions, 10-500 revolutions, 25-1000 revolutions, 25-500 revolutions, 50-1000 revolutions, 50-500 revolutions, 100-1000 revolutions, 100-500 revolutions, 150-1000 revolutions and 150-500 revolutions.

Additional Embodiments

Figure 12:
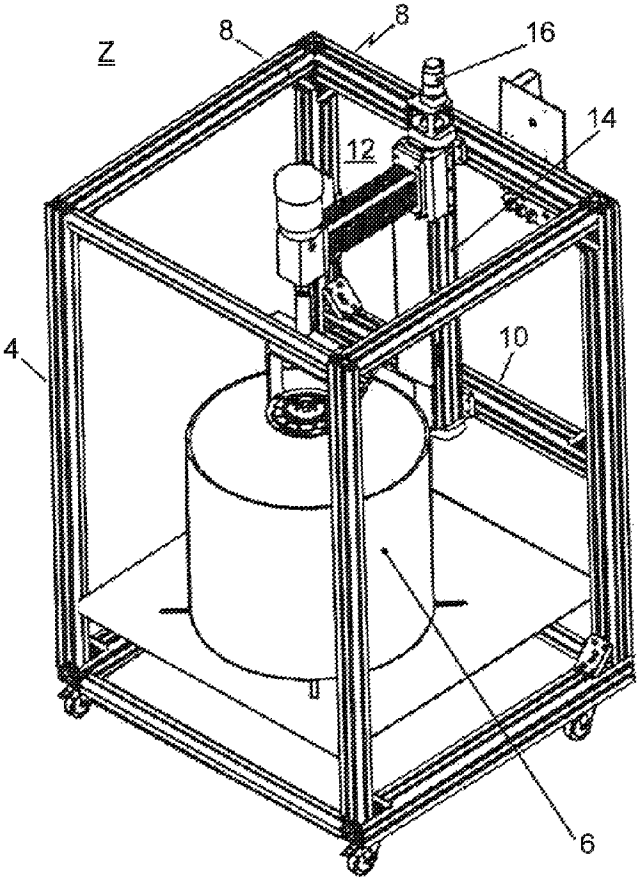
FIG. 12 depicts a coating apparatus according to the invention.

FIG. 12 depicts a coating apparatus 2. Frame 4 supports a tank 6 which contains a coating fluid when the apparatus is in use. Rails 8 and 10 of frame 4 support actuator assembly 12 which comprises vertical track member 14, step motor 16 and horizontal support member 18. Step motor 16 is capable of translating horizontal member 18 along vertical track member 14 to raise and lower member 18.

Figure 13:
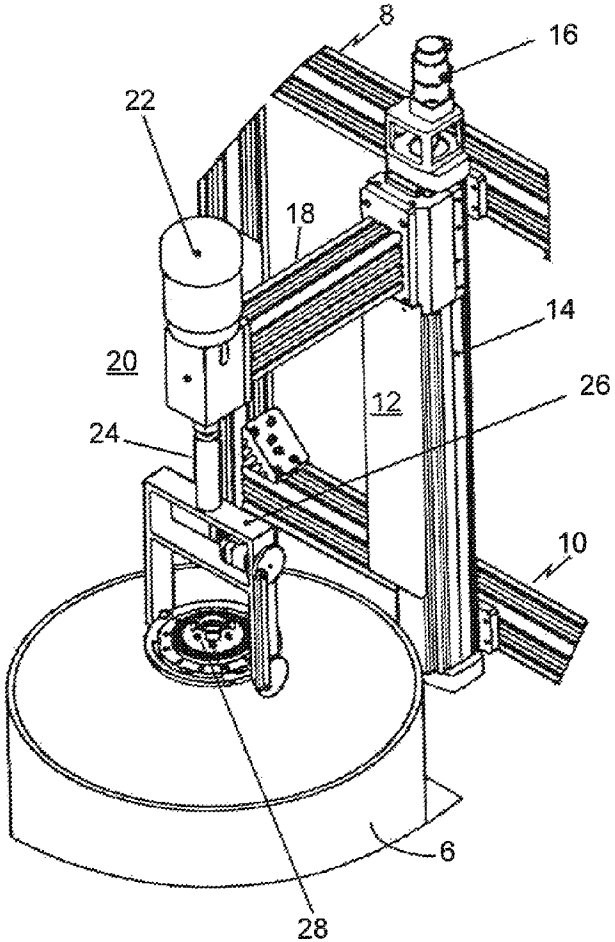
FIG. 13 is an enlargement of FIG. 12.

FIG. 13 is an enlargement of FIG. 12. Attached to the distal end of member 18 is spindle drive assembly 20 which comprises spin motor 22 which is attached to spindle 24. The spindle is attached to first gimbal 26. When spin motor 22 is activated it rotates spindle 24, first gimbal 26 and object 28 around the vertical axis.

Figure 14A:
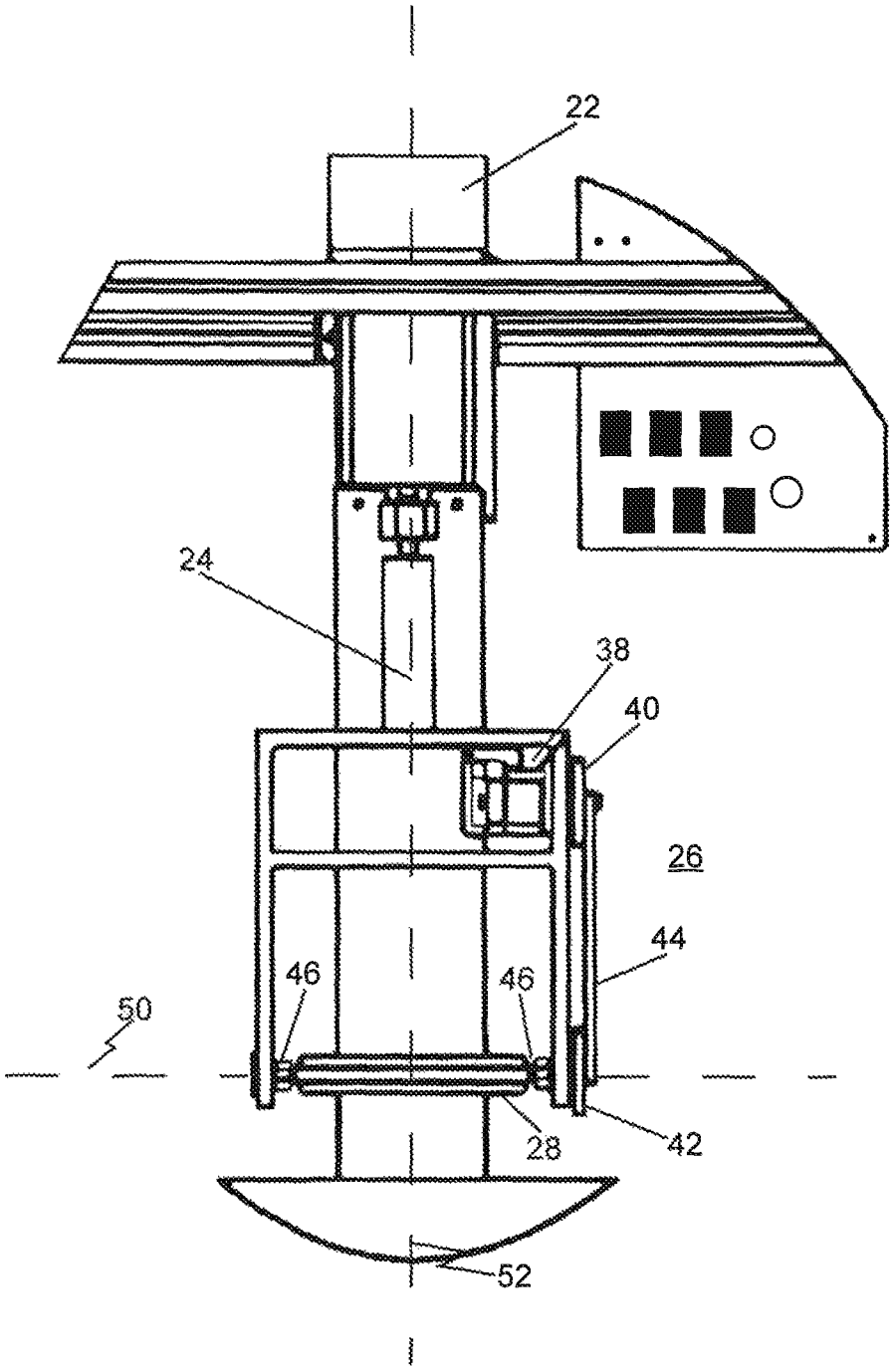
FIG. 14 A is a front view of spindle drive assembly 20, spin motor 22, spindle 24, part holder 26 and object 28.
Figure 14B:
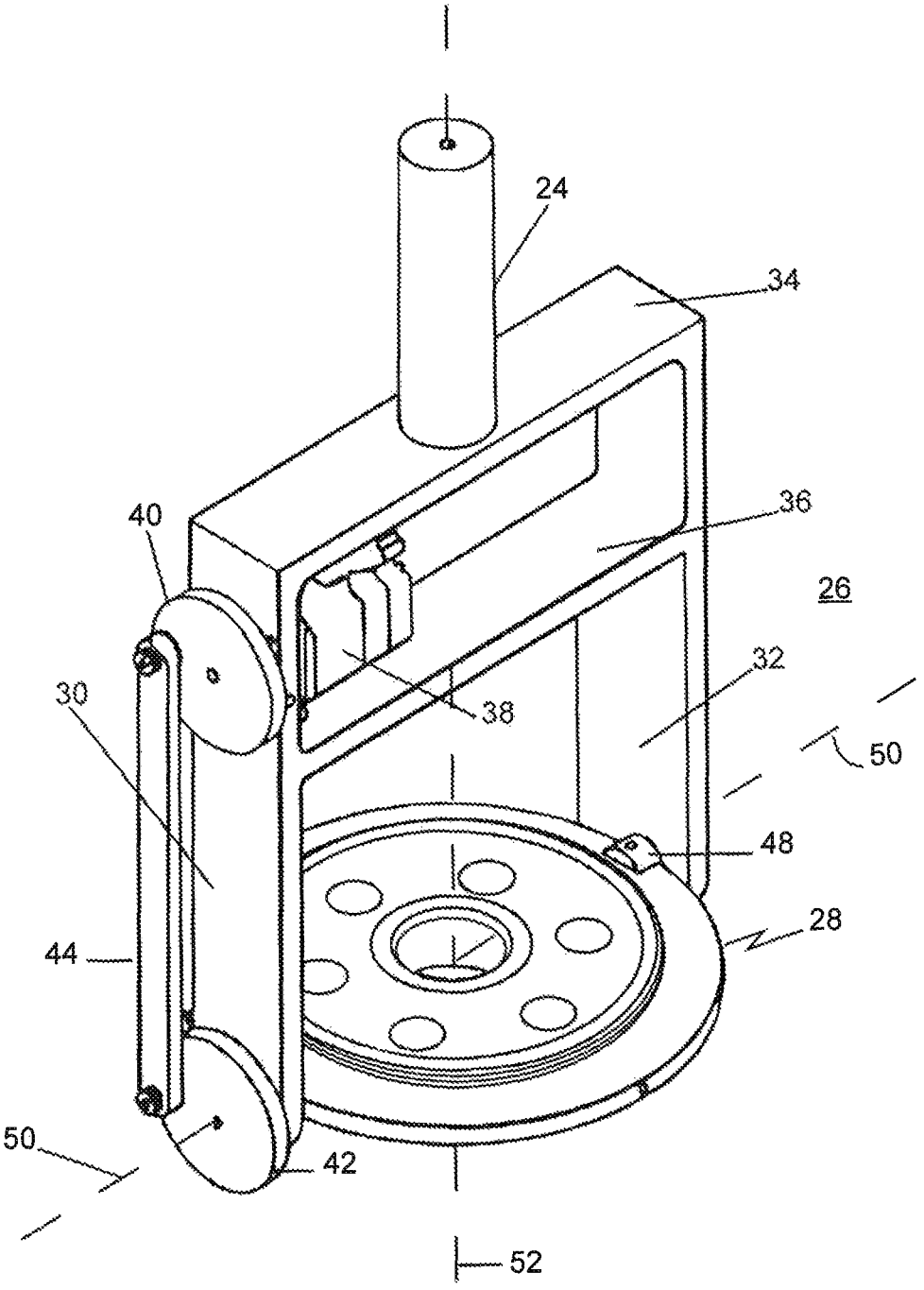

FIG. 14 A is a front view of spindle drive assembly 20, spin motor 22, spindle 24, first gimbal 26 and object 28. FIG. 14 B is a perspective view of first gimbal 26, and a second gimbal (defined by rotatable attachment points 46 and 48) and object 28. The first gimbal 26 comprises two arms 30 and 32 which are connected by parallel cross members 34 and 36. A motor 38 is positioned between cross members 34 and 36. The drive shaft of motor 38 (not shown) passes through arm 30 and is attached to circular drive 40. A second circular drive 42 is rotatably attached to the distal end of arm 30. The circular drives are connected the second gimbal via rod 44 which is rotatably attached near the edge of each circular drives. Rotatable attachment points 46 and 48 are located on the interior of the distal arms 30 and 32. Rotatable attachment point 46 is connected to circular drive 42. Attachment points 46 and 48 are designed to reversibly engage object 28. When motor 28 is engaged, circular drive 40 rotates. Circular drive 42 likewise rotates and with it attachment points 46 and 48 and object 28. The rotation is around horizontal axis 50.

Accordingly, the coater apparatus is designed to spin the object around the vertical axis 52 and rotate the object around the horizontal axis 50 either separately or at the same time. Such spinning and rotating can be further modulated by translation of the object in the vertical direction to either immerse or withdraw all or part of the object from the coating fluid.

At least those portions of the part holder that will be immersed in the coating fluid are preferably covered with an inert substance such as Teflon™ to prevent contamination of the coating fluid.

There are other ways to rotate object 28 around the horizontal axis 50. For example a motor or motors can replace circular drives 40 and 42 and directly engage one or both of attachment point 46 and 48. In such an embodiment, the motor should be sealed and coated (e.g. with Teflon™) so that it can be immersed in the coating fluid without contaminating the coating fluid.

Figure 15:
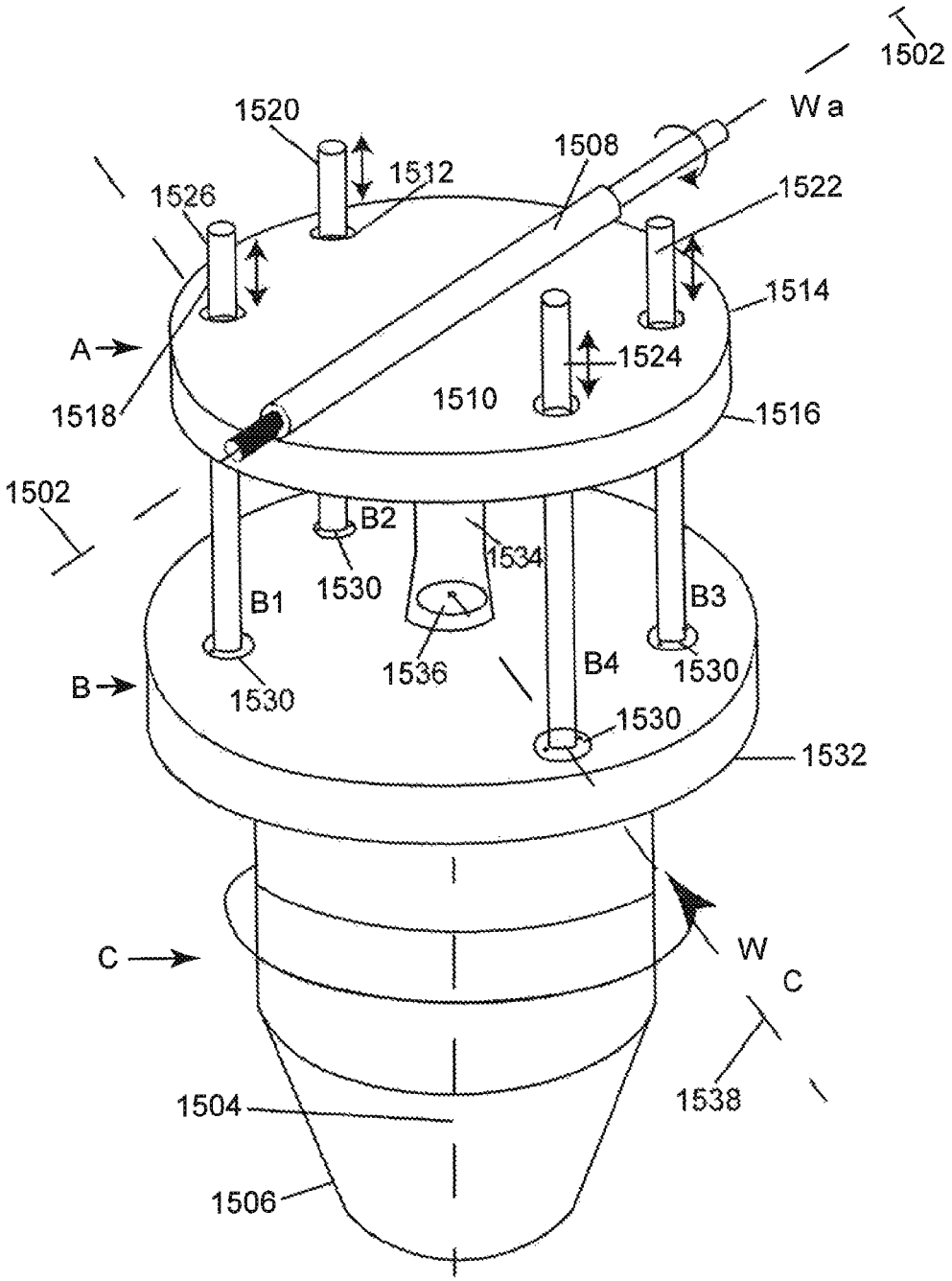
FIG. 15 is another embodiment of a coating apparatus.

FIG. 15 is a perspective view of an embodiment where an object can be rotated completely around first horizontal axis 1502 and vertical axis 1504 and have its angle of rotation around axis vertical axis 1505 altered. Gimbal chuck 1506 is rotatable around axis 1504 and engages the object to be coated (not shown). The motor driving gimbal chuck 1506 is attached to the bottom of plate 1532 and is not shown. Gimbal 1508 is attached to plate 1510 and rotates around axis 1502. Plate 1510 has four holes 1512, 1514, 1516 and 1518 through which push-pull rods 1522, 1524, 1526 and 1528 pass. These push-pull rods are connected to ball joints 1530 on movable plate 1532. Movable plate 1532 is attached to plate 1510 via shaft 1534 and ball joint 1536. The angle of the plane of movable plate 1532 relative to the horizontal plane can be changed by translating two opposing or two adjacent push-pull rods. For example, if push-pull rod 1522 is pushed down and push-pull rod 1526 is pulled up, plate 532 and gimbal chuck 1506 will rotate about axis 1538 thereby changing the angle of the gimbal chuck 1506 and object to vertical axis 1504.

Centrifugal Force

The surface forces experienced by an object rotating around two and/or three axes is the vectoral combination of the centrifugal forces generated by rotation of the object around two and/or three axis with the gravitational force.

The force equations can be written as:

$$F_{effective}(\text{total})=F_{gravity}(z)+F_{centripetal}(r,\text{theta,psi});\ \text{or}$$

$$F_{apparent}(\text{total})=F_{gravity}(z)+F_{centrifugal}(r,\text{theta,psi})$$

where r is the radius, theta is the angle of rotation and psi is the angle of from the axis of rotation.

The centrifugal acceleration along the radial direction is given by $$a_r = -\omega^2 R\, u_r = -\frac{|v|^2}{R} u_r$$

The gravitational acceleration in the vertical axis, z, is given by F=mg, where m is the mass of the coating fluid element and g is the gravitational constant.

When a coated object is spun around two or three axes, centrifugal forces are applied to the coated object which are directed outward from and perpendicular to each axis of rotation. These force vectors combine to apply a single centrifugal force to the coating fluid which can be changed by changing the speed and direction of rotation around each axis or the angle of the object about one or more axes. The combination of the gravitational force in the vertical direction and the centrifugal force produces an apparent force The effect of this force can be the moving of coating fluid over, for example, a complex surface so as to produce a uniform thin film of coating solution.

The apparent force Fa is opposed by effective force Fe which is the sum of the gravitational force and the centripetal force which holds the coating fluid on the surface of the object. These centripetal forces include Van der Waals forces, electrostatic interaction and covalent bonding between the surface and the coating fluid as well as physical obstructions on the surface of the object. At steady state, Fa=Fe.

The thickness of the coating solution can be controlled by the speed of rotation, the axis of rotation, the time progression of said axis, as well as the specific orientation from the vertical.

Coating Fluids/Solutions

The coating fluid can be any coating fluid used to apply thin films. Such fluids include organic polymers, organic monomers and sol-gel precursors.

Preferred sol-gel precursor solutions are disclosed in U.S. Patent Application No. 61/438,862 filed Feb. 2, 2011 and U.S. patent application Ser. No. 13/365,066 filed Feb. 2, 2012 entitled Solution Derived Nanocomposite Precursor Solutions and Methods for Making Thin Films, each of which are expressly incorporated herein by reference. These precursor solutions are sometimes referred to as SDN precursor solutions. In preferred embodiments, the vessel of the coater apparatus contains such SDN precursor solutions and the method is carried out using SDN precursor solutions as the coating fluid.

Briefly, SDN precursor solutions contain (1) one or more, preferably two or more, sol-gel metal precursors and/or sol-gel metalloid precursors, (2) a polar protic solvent and (3) a polar aprotic solvent. The amount of each component is such that the SDN precursor solution forms a gel after a shear force is applied to the precursor solution or a thin layer of precursor solution. In a preferred embodiment, the amount of polar aprotic solvent is about 1-25 vol % of the precursor solution.

The metal in the sol-gel metal precursors can be one or more of the transition metals, the lanthanides, the actinides, the alkaline earth metals and Group IIIA through Group VA metals or combinations thereof with another metal or metalloid.

The metalloid in the sol-gel metalloid precursors can be one or more of boron, silicon, germanium, arsenic, antimony, tellurium, bismuth and polonium or combinations thereof with another metalloid or metal.

The sol-gel metal precursors can be metallic compounds selected from organometallic compounds, metallic organic salts and metallic inorganic salts. The sol-gel metalloid precursors can be metalloid compounds selected from organometalloid compounds, metalloid organic salts and metalloid inorganic salts. When more than one metal or metalloid is used it is preferred that one be an organic compound such as an alkoxide and the other an organic or inorganic salt.

The polar protic solvent used in the precursor solution is preferably an organic acid or alcohol, more preferably a lower alkyl alcohol such as methanol and ethanol. Water may also be present in the solution.

The polar aprotic solvent can be a halogenated alkane, alkyl ether, alkyl ester, ketone, aldehyde, alkyl amide, alkyl amine, alkyl nitrile or alkyl sulfoxide. Preferred polar aprotic solvents include methyl amine, ethyl amine and dimethyl formamide.

In one embodiment, the metal and/or metalloid precursor is dissolved in the polar protic solvent. The polar aprotic solvent is then added while the solution is stirred under conditions that avoid non-laminar flow. Acid or base, which is used as a catalyst for polymerization of the metal and/or metalloid precursors, can be added before or after the addition of the polar aprotic solvent. Preferably, the acid or base is added drop wise in a one step process while stirring.

If too much polar aprotic solvent is added gelation can occur. Accordingly, the amount of polar aprotic solvent can be determined empirically for each application. The amount of polar aprotic solvent needs to be below the amount that causes gelation during mixing but be sufficient to cause gelation of the precursor solution after a shear force is applied to the precursor solution, e.g. during withdrawal for the solution or when a shear force is applied to a thin film of the precursor solution that has been deposited on the surface of a substrate, e.g. by application of centrifugal force to the thin film solution using the coating apparatus disclosed herein.

The SDN precursor solutions are typically Non-Newtonian dilatant solutions. As used herein, "dilatant" refers to a solution where the dynamic viscosity increases in a non linear manner as shear force is increased.

As used herein, the term "gelled thin film", "thin film gel", "sol-gel thin film" or grammatical equivalents means a thin film where the metal and/metalloid sol-gel precursors in a precursor solution form polymers which are sufficiently large and/or cross linked to form a gel. Such gels typically contain most or all of the original mixed solution and have a thickness of about 1 nm to about 10,000 nm, more preferably about 1 nm to about 50,000 nm, more preferably about 1 nm to about 5,000 nm and typically about 1 nm to about 500 nm.

Gelled thin films and the precursor solutions used to make them can also contain polymerizable moieties such as organic monomers, and cross-linkable oligomers or polymers. Examples include the base catalyzed reaction between melamine or resorcinol and formaldehyde followed by acidization and thermal treatment.

In some cases one or more of the metal and/or metalloid precursors can contain cross-linkable monomers that are covalently attached to the metal or metalloid typically via an organic linker. Examples include diorganodichlorosilanes which react with sodium or sodium-potassium alloys in organic solvents to yield a mixture of linear and cyclic organosilanes.

When cross-linkable moieties are used, it is preferred that the precursor solution also contain a polymerization initiator. Examples of photo-inducible initiators include titanocenes, benzophenones/amines, thioxanthones/amines, bezoinethers, acylphosphine oxides, benzilketals, acetophenones, and alkylphenones. Heat inducible initiators which are well known to those in the art can also be used.

As used herein, the term "thin film", "sol-gel thin film" or grammatical equivalents means the thin film obtained after most or all of the solvent from a gelled thin film is removed. The solvent can be removed by simple evaporation at ambient temperature, evaporation by exposure to increased temperature of the application of UV, visible or IR radiation. Such conditions also favor continued polymerization of any unreacted or partially reacted metal and/or metalloid precursors. Preferably, 100 vol % of the solvent is removed although in some cases as much as 30 vol % can be retained in the thin gel. Single coat thin films typically have a thickness of between about 1 nm and about 10,000 nm, between about 1 nm and 1,000 nm and about 1 nm and 100 nm. When more than one coat of precursor composition is applied to form a thin film, the first layer can be allowed to gel and then converted to a thin film. A second coat of the same or a different precursor solution can then be applied and allowed to gel followed by its conversion to a thin film. In an alternate embodiment, the second coat of precursor composition can be applied to the gelled first layer. Thereafter the first and second gelled layers are converted to first and second thin films. Additional layers can be added in a manner similar to the above described approaches.

When one or more polymerization moieties are present, it is preferred that the thin file gel be exposed to an appropriate initiating condition to promote polymerization of the polymerizable moieties. For example, UV radiation can be used with the above identified photo-inducible initiators.

As used herein, a "hybrid thin film gel" or grammatical equivalents refers to a thin film gel that contains a polymerizable organic component.

As used herein, a "hybrid thin film" or grammatical equivalents refers to a thin film that contains an organic component that has been polymerized or partially polymerized.

The metal in said one or more sol-gel metal precursors is selected from the group consisting of transition metals, lanthanides, actinides, alkaline earth metals, and Group IIIA through Group VA metals. Particularly preferred metals include Al, Ti, Mo, Sn, Mn, Ni, Cr, Fe, Cu, Zn, Ga, Zr, Y, Cd, Li, Sm, Er, Hf, In, Ce, Ca and Mg.

The metalloid in said one or more sol-gel metalloid precursors is selected from boron, silicon, germanium, arsenic, antimony, tellurium, bismuth and polonium. Particularly preferred metalloids include B, Si, Ge, Sb, Te and Bi.

The sol-gel metal precursors are metal-containing compounds selected from the group consisting of organometallic compounds, metallic organic salts and metallic inorganic salts. The organometallic compound can be a metal alkoxide such as a methoxide, an ethoxide, a propoxide, a butoxide or a phenoxide.

The metallic organic salts can be, for example, formates, acetates or propionates.

The metallic inorganic salts can be halide salts, hydroxide salts, nitrate salts, phosphate salts and sulfate salts.

Metalloids can be similarly formulated.

Solvents

Solvents can be broadly classified into two categories: polar and non-polar. Generally, the dielectric constant of the solvent provides a rough measure of a solvent's polarity. The strong polarity of water is indicated, at 20° C., by a dielectric constant of 80. Solvents with a dielectric constant of less than 15 are generally considered to be nonpolar. Technically, the dielectric constant measures the solvent's ability to reduce the field strength of the electric field surrounding a charged particle immersed in it. This reduction is then compared to the field strength of the charged particle in a vacuum. The dielectric constant of a solvent or mixed solvent as disclosed herein can be thought of as its ability to reduce the solute's internal charge. This is the theoretical basis for the reduction in activation energy discussed above.

Solvents with a dielectric constant greater than 15 can be further divided into protic and aprotic. Protic solvents solvate anions strongly via hydrogen bonding. Water is a protic solvent. Aprotic solvents such as acetone or dichloromethane tend to have large dipole moments (separation of partial positive and partial negative charges within the same molecule) and solvate positively charged species via their negative dipole.

Polar Protic Solvents

Examples of the dielectric constant and dipole moment for some polar protic solvents are presented in Table 1.

TABLE 1

Polar protic solvents

| Solvent | Chemical formula | Boiling point | Dielectric constant | Density | Dipole moment |
|---|---|---|---|---|---|
| Formic acid | H—C(═O)OH | 101° C. | 58 | 1.21 g/ml | 1.41 D |
| n-Butanol | $CH_3$—$CH_2$—$CH_2$—$CH_2$—OH | 118° C. | 18 | 0.810 g/ml | 1.63 D |
| Isopropanol (IPA) | $CH_3$—CH(—OH)—$CH_3$ | 82° C. | 18 | 0.785 g/ml | 1.66 D |
| n-Propanol | $CH_3$—$CH_2$—$CH_2$—OH | 97° C. | 20 | 0.803 g/ml | 1.68 D |
| Ethanol | $CH_3$—$CH_2$—OH | 79° C. | 30 | 0.789 g/ml | 1.69 D |
| Methanol | $CH_3$—OH | 65° C. | 33 | 0.791 g/ml | 1.70 D |
| Acetic acid | $CH_3$—C(═O)OH | 118° C. | 6.2 | 1.049 g/ml | 1.74 D |
| Water | H—O—H | 100° C. | 80 | 1.000 g/ml | 1.85 D |

Preferred polar protic solvents have a dielectric constant between about 20 and 40. Preferred polar protic solvents have a dipole moment between about 1 and 3.

Polar protic solvents are generally selected from the group consisting of organic acids and organic alcohols. When an organic acid is used as a polar protic solvent, it is preferred that it be formic acid, acetic acid, propionic acid or butyric acid, most preferably acetic and/or propionic acids.

When an organic alcohol is used as a polar protic solvent it is preferred that it be a lower alkyl alcohol such as methyl alcohol, ethyl alcohol, propyl alcohol or butyl alcohol. Methanol and ethanol are preferred.

Polar Aprotic Solvents

Examples of the dielectric constant and dipole moment for some polar aprotic solvents are set forth in Table 2.

TABLE 2

Polar aprotic Solvents

| Solvent | Chemical formula | Boiling point | Dielectric constant | Density | Dipole moment |
|---|---|---|---|---|---|
| Dichloromethane (DCM) | $CH_2Cl_2$ | 40° C. | 9.1 | 1.3266 g/ml | 1.60 D |
| Tetrahydrofuran (THF) | /—$CH_2$—$CH_2$—O—$CH_2$—$CH_2$—\ | 66° C. | 7.5 | 0.886 g/ml | 1.75 D |
| Ethyl acetate | $CH_3$—C(=O)—O—$CH_2$—$CH_3$ | 77° C. | 6.02 | 0.894 g/ml | 1.78 D |
| Acetone | $CH_3$—C(=O)—$CH_3$ | 56° C. | 21 | 0.786 g/ml | 2.88 D |
| Dimethylformamide (DMF) | H—C(=O)N$(CH_3)_2$ | 153° C. | 38 | 0.944 g/ml | 3.82 D |
| Acetonitrile (MeCN) | $CH_3$—C≡N | 82° C. | 37.5 | 0.786 g/ml | 3.92 D |
| Dimethyl sulfoxide (DMSO) | $CH_3$—S(=O)—$CH_3$ | 189° C. | 46.7 | 1.092 g/ml | 3.96 D |

Preferred polar aprotic solvents have a dielectric constant between about 5 and 50. Preferred polar aprotic solvents have a dipole moment between about 2 and 4.

The polar aprotic solvent can be selected from the group consisting of asymmetrical halogenated alkanes, alkyl ether, alkyl esters, ketones, aldehydes, alkyl amides, alkyl amines, alkyl nitriles and alkyl sulfoxides.

Asymmetrical halogenated alkanes can be selected from the group consisting of dichloromethane, 1,2-dichloroethane, 1,2-dichloropropane, 1,3-dichloropropane, 2,2-dichloropropane, dibromomethane, diiodomethane, bromoethane and the like.

Alkyl ether polar aprotic solvents include tetrahydrofuran, methyl cyanide and acetonitrile.

Ketone polar aprotic solvents include acetone, methyl isobutyl ketone, ethyl methyl ketone, and the like.

Alkyl amide polar aprotic solvents include dimethyl formamide, dimethyl phenylpropionamide, dimethyl chlorobenzamide and dimethyl bromobenzamide and the like.

Alkyl amine polar aprotic solvents include diethylenetriamine, ethylenediamine, hexamethylenetetramine, dimethylethylenediamine, hexamethylenediamine, tris(2-aminoethyl) amine, ethanolamine, propanolamine, ethyl amine, methyl amine, and (1-2-aminoethyl)piperazine.

A preferred alkyl nitrile aprotic solvent is acetonitrile.

A preferred alkyl sulfoxide polar aprotic solvent is dimethyl sulfoxide. Others include diethyl sulfoxide and butyl sulfoxide.

Another preferred aprotic polar solvent is hexamethylphosphoramide.

SDN Precursor Solutions

The total amount of metal and/or metalloid precursors in the precursor solution is generally about 5 vol % to 40 vol % when the precursors are a liquid. However, the amount may be from about 5 vol % to about 25 vol % and preferably from about 5 vol % to 15 vol %.

The polar protic solvent makes up most of the mixed solvent in the precursor solution. It is present as measured for the entire volume of the precursor solution at from about 50 vol % to about 90 vol %, more preferably about 50 to about 80 vol % and most preferably about 50-70 vol %.

The polar aprotic solvent in the precursor solution is about 1-25 vol % of the solution, more preferably about 1-15 vol % and most preferably about 1-5 vol %.

Coating Methods

The coating methods comprise immersing all or part of an object into a coating fluid along a first vertical axis, withdrawing the object from the coating fluid and rotating the object around first and second axes. The rotating around the first and second axes produces centrifugal forces on the surface of the object which in combination with the gravitational force form a uniform film of the coating solution over all or part of the coated surface. In some cases, the rotating around the first axis and the second axis occurs at the same time. In other cases, the rotating around the first axis and the second axes occurs at different times.

When the object is immersed in a vessel containing the coating solution, it can be rotated around the vertical axis. When this is the case, the rotational speed can be in the range of 1 to 500 rpm. It can also be rotated about or around second and/or third axes at the same or different speeds.

After being withdrawn, the rotational speed can be in the range of 1-5000 rpm around any or all of the three axes. The lower rotational limit can be 2, 3, 4, 5, 6, 7, 8, 9, 10, 25, 50, 75, 100, 125, 150, 200, 250, 500, 750, 1,000, 1500 or 2,000 rpm. The upper rotational limit can be 4500, 4000, 3500, 3000, 2500, 2000, 1500, 1000, 500, 250 or 100 rpm. The rpm range can be any combination of these upper and lower limits. Preferred ranges are 3-1000 rpm, 3-500 rpm, 4-1000 rpm, 4-500 rpm, 5-1000 rpm, 5-500 rpm, 10-1000 rpm, 10-500, rpm, 25-1000 rpm, 25-500, rpm 50-1000 rpm, 50-500 rpm, 100-1000 rpm, 100-500 rpm, 150-1000 rpm and 150-500 rpm.

The number of revolutions for a typical object coating operation can range from range of 1-5000 revolutions or higher depending on the application. The lower revolution limit can be 2, 3, 4, 5, 6, 7, 8, 9, 10, 25, 50, 75, 100, 125, 150, 200, 250, 500, 750, 1,000, 1500 or 2,000 revolutions. The upper revolution limit can be 4500, 4000, 3500, 3000, 2500, 2000, 1500, 1000, 500, 250 or 100 revolutions. The revolution range can be any combination of these upper and lower limits. Preferred ranges are 3-1000 revolutions, 3-500 revolutions, 4-1000 revolutions, 4-500 revolutions, 5-1000 revolutions, 5-500 revolutions, 10-1000 revolutions, 10-500 revolutions, 25-1000 revolutions, 25-500 revolutions, 50-1000 revolutions, 50-500 revolutions, 100-1000 revolutions, 100-500 revolutions, 150-1000 revolutions and 150-500 revolutions.

The object is preferably withdrawn from the coating fluid at a rate in the range of 1 to 500 mm/min.

In the preferred embodiments, the coating apparatus and method are preferably controlled by an algorithm and computer that controls vertical translation of the object, rotational speed around or about two or more rotational axes.

Coating Systems and Processes

Figure 17:
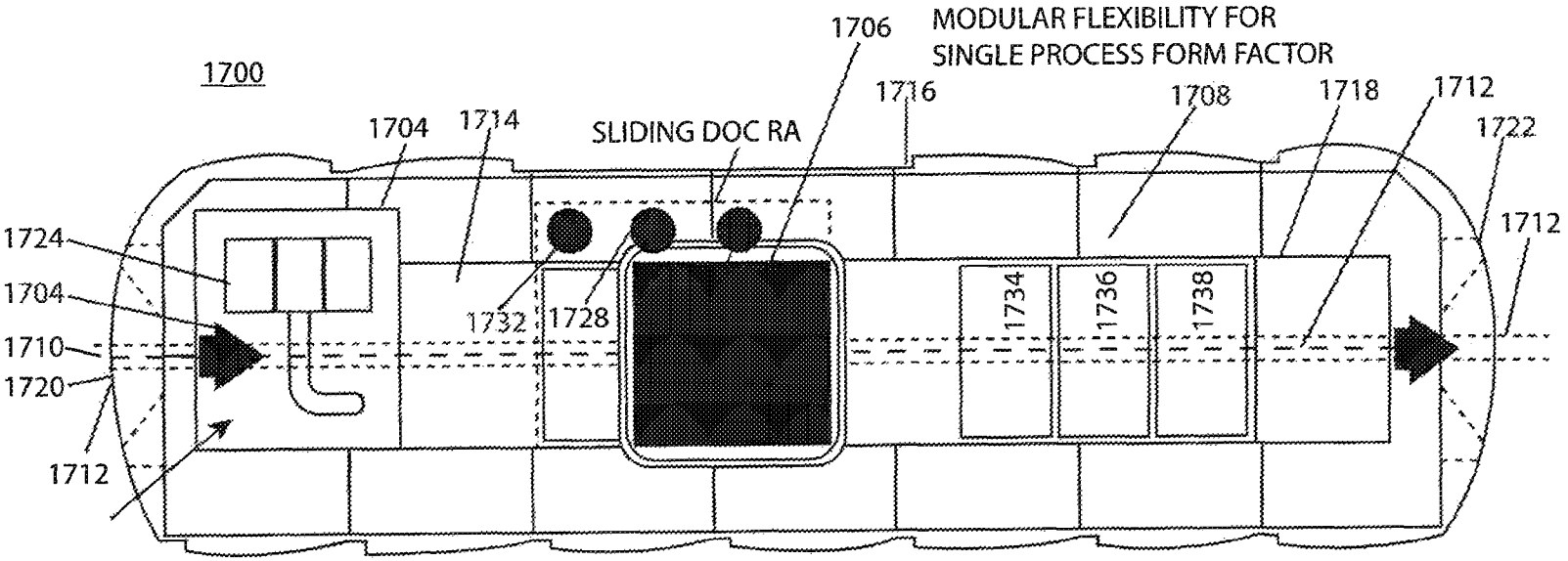
FIG. 17 depicts a top view of a system for coating objects.

In a preferred embodiment, the system for coating an object comprises four components: (1) a pre-treatment unit; (2) a first processing unit; (3) a first post-treatment unit and (4) one or more coating apparatus each configured to engage an object and rotate it around or about two or more axes as set forth above. FIG. 17 is a top view of an exemplary system 1700. The system is enclosed by external walls 1702. Contained with these walls is pretreatment unit 1704, processing unit 1706 and post-treatment unit 1708. The system is configured so that coating apparatus 1710 can be transported between the pre-treatment unit 1704 and the first processing unit 1706 and between the first processing unit 1706 and the first post-treatment unit 1708. The system or one or more of units 1704, 1706 and/or 1708 are preferably enclosed so that the temperature and atmosphere within the system or units can be controlled.

A track system is positioned above the various units and includes a track 1712 and appropriate drive and control mechanisms (not shown) to transport the coating apparatus 1710 as it traverses the track and to stop the coating apparatus at appropriate positions in the treatment and processing units.

In some embodiments, the system includes first transfer units 1714, 1716 and 1718 between the pre-treatment unit 1704 and the first processing unit 1706 and between the first processing unit 1706 and the post-treatment unit 1708. The track system is adapted in this situation, so that the transport of the coating apparatus between the pre-treatment unit 1704 and first post-treatment unit 1708 is not interrupted.

The system preferably has an entry port 1720 which is before or upstream from the pre-treatment unit 1704 so that an object to be coated can be attached to the coating apparatus 1710. More preferably, the object is attached to a coating apparatus which is external to the enclosed portion of the system. In the latter situation, the track system preferably extends outward from the enclosed system and supports the coating apparatus. Thereafter, the coating apparatus can be transported via the track system through the entry port and into the pre-treatment and other units as necessary. After the object is coated and treated, the system can reverse the movement of the coating apparatus so that the object can be removed at the entry port 1720.

The system can also include an exit port 1722 after the post-treatment unit 1708. Such a configuration allows for continuous operation of the system in which coating a first coating apparatus 1710 can enter the system at the pre-treatment unit 1704, move to the processing unit 1706 to be coated, move to the post-treatment unit 1708 for irradiation and exit via the exit port 1722. A second coating apparatus can enter the system at the pretreatment unit 1704 as the first coating apparatus 1710 exits it. This allows for multiple coating apparatus to be present in the system thereby increasing the operational efficiency of the system.

In a preferred embodiment, the pretreatment unit 1704 contains a plasma head 1724. The plasma head can produce, for example, an atmospheric plasma or oxygen plasma which contacts the surface of the object to be coated. In this embodiment, the plasma head can be stationary and the object is rotated around or about two or more axes. In a preferred embodiment, a plasma head with six axes of rotation is used. In this embodiment the six axis plasma head is capable of exposing all or part of the surface of the object. The combination of object rotation around or about two or more axes by the coating apparatus and the use of a multi-axis plasma head can also be used.

The pre-treatment of the object's surface, e.g. by plasma treatment, activates the surface which in turn increases the number of covalent bonds formed between the object's surface and a first thin film. Pre-treatment results in a first thin film that adheres more strongly to the surface than if pre-treatment is not performed. Pre-treatment of the first thin film surface can also be used to increase the adherence of a second thin film to the surface of the first thin film. In this embodiment, the coating apparatus is transported to the pre-treatment unit or to a second pre-treatment unit for pre-treatment and then coated with the same or different coating fluid.

In other embodiments, the pre-treatment unit can contain one or more vessels which contain an activation solution such as a solution of acid or base. In these embodiments all or part of the surface of the object to be coated is immersed in the activation solution with or without rotation around or about two or more axes.

The processing unit 1706 contains at least a first coating vessel (not shown) which is designed to hold a coating fluid. The coating vessel is configured to translate vertically upward and downward when one of the coating apparatus is over the first vessel. Alternatively, the coating apparatus can be configured to translate vertically downward and upward when the coating apparatus is over the vessel. Additional coating vessels can be contained in the processing unit 1706. For example, two or more vessels can be configured on a processing carousel or processing track system to position different vessels beneath the coating apparatus 1710. The coating vessel may also be more complex than a simple "bucket" type container. It may have an inner region of exclusion, and hence appear as more of a "doughnut" type of container.

The system typically has a first fluid storage vessel 1728 in fluid communication with the first coating vessel. This first storage vessel contains coating fluid which is pumped into the first vessel to replace coating fluid lost from the first vessel due to the coating process. A second fluid storage vessel 1730 in fluid communication with the first coating vessel can also be used to hold the same or a different coating fluid to facilitate continuous operation of the system or to change to a different coating fluid. A third fluid storage vessel 1732 in fluid communication with the first coating vessel may be present to store a rinse solution which is used to clean the vessel during maintenance.

In some embodiments, a recirculation loop (not shown) is present between the vessel and one or more of storage vessels 1728, 1730 and/or 1732. The recirculation loop has a subunit which is designed to reverse any gelation that may occur in the coating solution such as may occur when SDN sol-gel precursor solutions are used. The recirculation loop subunit can comprise one or more ultrasonic transducers configured to impart ultrasonic energy into the subunit. The ultrasonic energy reverses the gelation. Alternatively, or in addition to the ultrasonic subunit, one or more ultrasonic transducers can be configured to impart ultrasonic energy into the first vessel, the first fluid storage vessel 1728, the second fluid storage vessel 1730 or the means of fluid communication between the first coating vessel and the storage vessels. A recirculation loop containing ultrasonic transducers for use in a roll coater is disclosed in US Patent Publication 2001/0244136 (Ser. No. 13/078,607) and can be readily adapted for use in the coating system disclosed herein.

The post treatment unit 1708 can be any know treatment unit such as an oven or a chamber in which reactive gases can be introduced. In the preferred embodiments, the post treatment unit comprises at least one irradiation subunit preferably chosen from UV irradiation subunit 1734, visible irradiation subunit 1736 or IR irradiation subunit 1738. In preferred embodiments, at two of UV irradiation subunit 1734, visible irradiation subunit 1736 or IR irradiation subunit 1738 are used and most preferably all three irradiation subunits. At least one of the wavelength, intensity and duration of illumination can be varied in at least one of the irradiation subunits, preferably two of the irradiation units and most preferably all three irradiation units.

The coating apparatus used in the system is the coating apparatus described above. It comprises a first gimbal connected to a first mechanism to rotate the first gimbal about a first axis; a second gimbal connected to the first gimbal to allow rotation about a second axis; a second mechanism connected to the second gimbal to rotate the second gimbal about the second axis; and an object holder connected to the second gimbal. When so configured the object holder and the object in the object holder is rotatable around or about the first and second axes.

Figure 18:
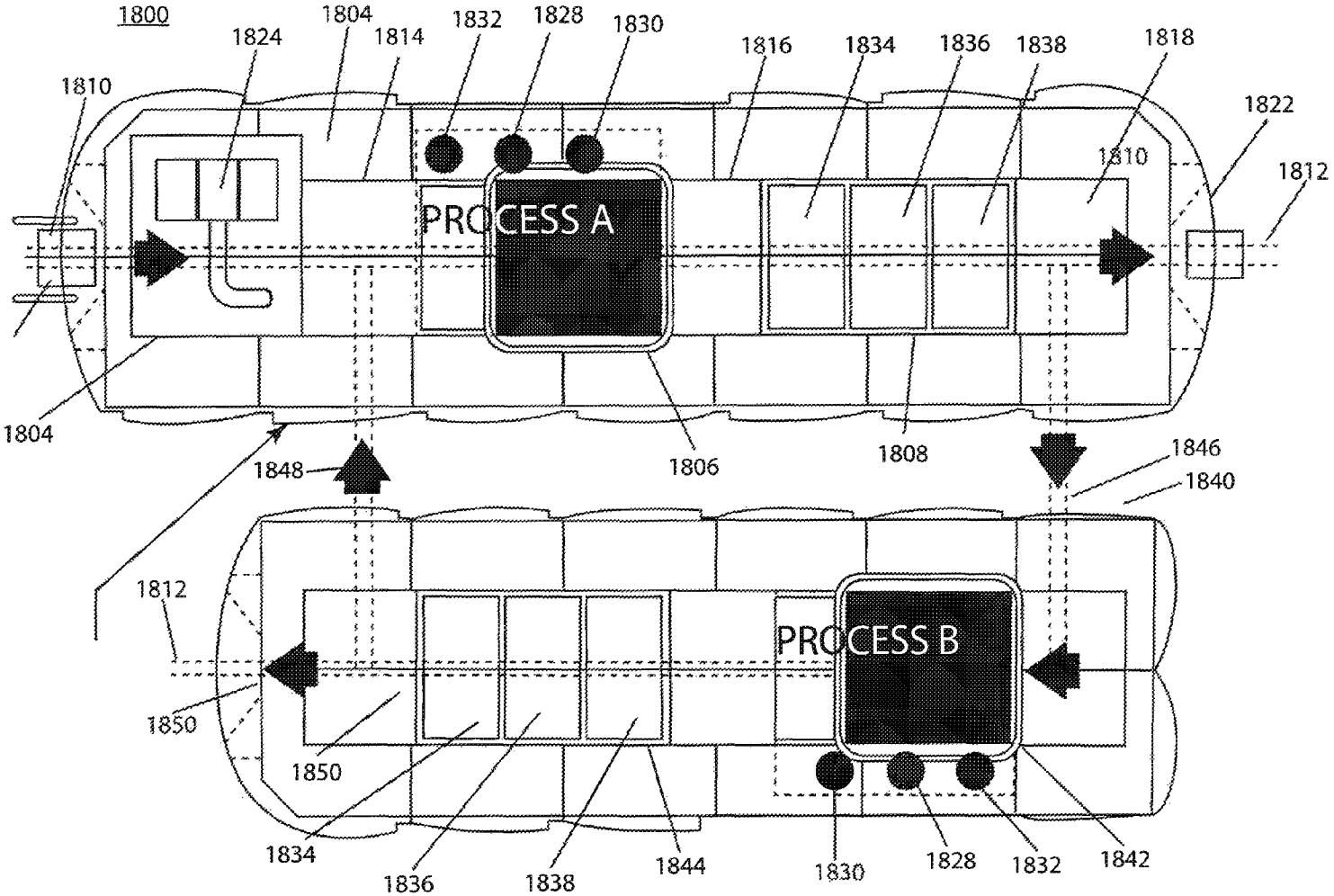
FIG. 18 depicts a top view of the system of claim 17 in combination with a module having additional processing and post-treatment units.

In another embodiment, the coating apparatus comprises a first gimbal connected to a first mechanism to rotate the first gimbal about a first axis; a second gimbal connected to the first gimbal to allow rotation about a second axis; a third gimbal connected to the second gimbal to allow rotation about a third axis; a second mechanism connected to the second gimbal to rotate the second gimbal about the second axis; a third mechanism connected to the third gimbal to rotate the third gimbal around or about the third axis; and an object holder connected to the third gimbal. This configuration provides for rotation of the holder and the object around or about the first, second and third axes The system can also include a second processing unit and a second post-treatment unit in an independent possessing module 1840 as shown in FIG. 18. Components of the embodiment shown in FIGS. 17 and 18 that are the same are designated with numbers where the last two digits are the same. The system in FIG. 17 can be considered to be a first processing module. The second processing unit 1842 is configured to receive the coating apparatus from the first post-treatment unit 1808 and the second post-treatment unit 1844 is configured to receive the coating apparatus 1810 from the second processing unit 1842. In this embodiment tracks 1846 and 1848 are added to the system to connect the processing module 1840 to the first processing module of FIG. 17 to form a transport circuit for the coating apparatus 1810 between the first processing section 1800 and the second processing module 1840. These tracks are preferable contained with closed passages (not shown) to prevent contamination and to control temperature and the composition of the atmosphere in the system as needed.

The coating apparatus 1810 can be transported from the pretreatment unit 1804 to the second post-treatment unit 1844 and from the second post-treatment unit 1844 to the pretreatment unit 1804 (not shown), the transfer unit 1814 or directly to the first processing unit 1816 (not shown). The system can have an exit port 1850 after the second post treatment unit 1844.

The embodiment in FIG. 18 is a dual process configuration where an object can be coated in processing unit 1806 of the first processing module followed by post treatment in unit 1808 in the second processing module 1840. Thereafter it can be transported to processing module 1840 for post treatment in units 1842 and 1844. The object can then be transported back to the first processing unit 1806 or the second processing unit 1842 in the first processing module for additional coating.

Additional processing modules can be incorporated into the coating system to increase the flexibility of the system such as to provide different coating solutions or to increase the capacity of the system to use additional coating apparatus. The system in FIG. 18 shows module 1840 in a parallel arrangement with the first module. These modules however can be configured linearly or in any other configuration.

Figure 19:
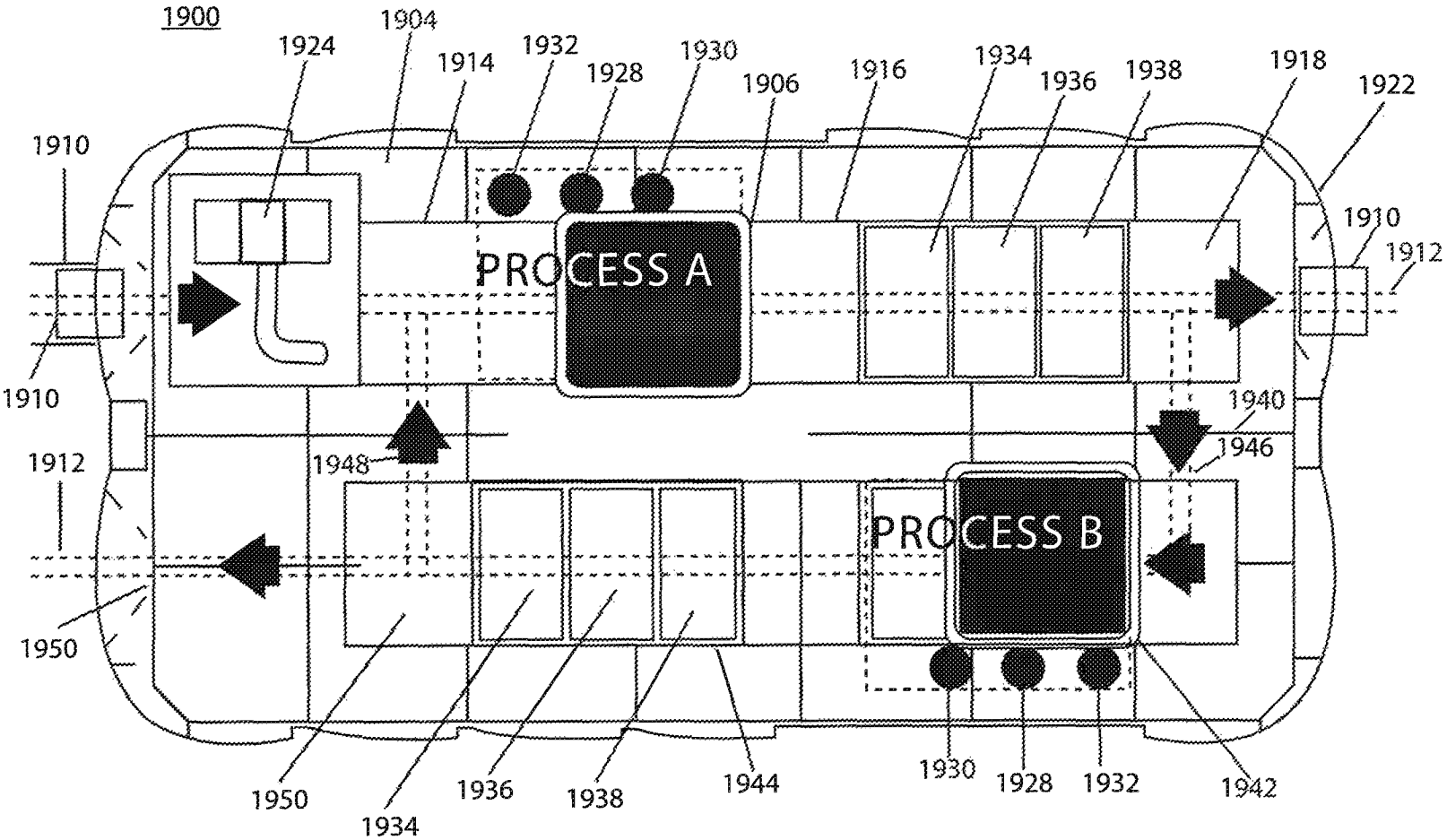
FIG. 19 depicts a top view of an integrated dual process coating system.

FIG. 19 is a top view of a dual process coating system where the processing modules of FIG. 18 are contained within a single enclosure.

The process for coating an object comprises pre-treating one or more surfaces of an object, immersing all or part of the object into a coating fluid along a first vertical axis, optionally rotating the object around or about the first vertical axis while immersed in the coating fluid, optionally rotating the object around or about a second axis while immersed in the coating fluid, withdrawing the object from the coating fluid to form a coated object, rotating the coated object around or about the vertical axis after the withdrawing, rotating the coated object around or about said second axis after said withdrawing, and post-treating the coated object.

In some embodiments, after withdrawal from the coating fluid, the coated object is rotated around or about the vertical axis and rotation around or about the second axis occurs at the same time. Alternatively, the rotation around or about the vertical axis and rotation around or about the second axis occur at different times.

In another embodiment, the coated object is rotated around or about first, second and/or a third axis at the same or different times.

The process can include pre-treating the object by exposing all or part of the surface of said object to an activating solution or a plasma.

The process can also include post-treating the coated object by exposing all or part of the surface of the coated object to at least one of UV radiation, visible radiation and IR radiation. In these embodiments, at least one of the wavelength, intensity and duration of the exposure can be varied.

In some process embodiments, the coating fluid is a solution derived nanocomposite (SDN) sol-gel precursor solution.

All references are expressly incorporated herein.

What is claimed is:

1. A coating apparatus comprising:

a first gimbal;

a second gimbal; and two opposing object holders;

wherein the first gimbal is attached to a first shaft connected to a first motor, wherein the second gimbal is rotatably attached within the first gimbal using a second shaft and a third shaft, wherein the second shaft is connected to a second motor, wherein the third shaft is connected to a third motor, wherein the two opposing object holders are attached to the second gimbal, and wherein the two opposing object holders are configured to engage and hold an object, wherein the first shaft is configured to translate vertically downward when the object is over at least one coating vessel to immerse the object into a coating solution contained in the at least one coating vessel, wherein the first shaft is configured to translate vertically upward to withdraw the object out of the coating solution contained in the at least one coating vessel, and wherein after withdrawal of the object from the coating solution, the first motor, the second motor, and the third motor are configured to rotate the object around or about two or more axes for distribution of the coating solution on a complex surface of the object using a multidirectional centrifugal force created by rotation of the object around or about the two or more axes simultaneously, wherein a first axis of the two or more axes is defined by the first shaft attached to the first gimbal, wherein a second axis of the two or more axes is defined by the second and third shafts attached to the second gimbal within the first gimbal.

2. The coating apparatus of claim 1, further comprising:

a third gimbal;

wherein the two opposing object holders are attached to the second gimbal by the third gimbal, wherein the third gimbal is rotatably attached within the second gimbal using a fourth shaft and a fifth shaft, wherein the fourth shaft is connected to a fourth motor, wherein the fifth shaft is connected to a fifth motor, wherein after withdrawal of the object from the coating solution, the first motor, the second motor, the third motor, the fourth motor, and the fifth motor are configured to rotate the object around or about the two or more axes for distribution of the coating solution on the complex surface of the object the multidirectional centrifugal force created by rotation of the object around or about the two or more axes simultaneously, and wherein a third axis of the two or more axes is defined by the fourth and fifth shafts attached to the third gimbal within the second gimbal.

3. The coating apparatus of claim 1, wherein the first gimbal has a shape selected from the group consisting of circular, semi-circular, quarter-circular, square, rectangular, and octagonal.

4. The coating apparatus of claim 1, wherein first motor, the second motor, and the third motor are configured to rotate the object around or about each of the two or more axes at a rotation speed of between about 150-500 RPM.

5. The coating apparatus of claim 1, wherein a thickness and uniformity of the coating solution is controlled by a speed of rotation of the object around or about each of the two or more axes and a time progression of each of the two or more axes.

6. The coating apparatus of claim 1, wherein the coating apparatus is configured to engage the object and rotate the object around or about the two or more axes while being pretreated using a plasma head.

7. The coating apparatus of claim 1, wherein the first motor, the second motor, and the third motor are configured to rotate the object around or about the two or more axes when the object is immersed in the coating solution contained in the at least one coating vessel.

8. The coating apparatus of claim 2, wherein the first motor, the second motor, the third motor, the fourth motor, and the fifth motor are configured to rotate the object around or about the two or more axes when the object is immersed in the coating solution contained in the at least one coating vessel.

9. The coating apparatus of claim 1, wherein the first axis of the two or more axes and the second axis of the two or more axes intersect at the same point.

10. The coating apparatus of claim 2, wherein at least two of the first axis, the second axis, and the third axis of the two or more axes intersect at the same point.

11. The coating apparatus of claim 10, wherein the first axis, the second axis, and the third axis of the two or more axes intersect at the same point.

12. The coating apparatus of claim 1, wherein the first motor, the second motor, and the third motor are configured to rotate the object at least 360 degrees around about at least one of the first axis and the second axis of the two or more axes.

13. The coating apparatus of claim 1, wherein the first motor, the second motor, and the third motor are configured to rotate the object at least 360 degrees around the first axis and the second axis of the two or more axes.

14. The coating apparatus of claim 2, wherein the first motor, the second motor, the third motor, the fourth motor, and the fifth motor are configured to rotate the object at least 360 degrees around at least three of the first axis, the second axis, and the third axis of the two or more axes.

15. The coating apparatus of claim 2, wherein the first motor, the second motor, the third motor, the fourth motor, and the fifth motor are configured to rotate the object less than 360 degrees about at least one of the first axis, the second axis, and the third axis of the two or more axes.

16. The coating apparatus of claim 2, wherein the first motor, the second motor, the third motor, the fourth motor, and the fifth motor are configured to rotate the object around or about each of the two or more axes at a rotation speed of between about 150-500 RPM.

* * * * *